US009790890B2

(12) United States Patent
Osborne

(10) Patent No.: US 9,790,890 B2
(45) Date of Patent: Oct. 17, 2017

(54) IMPROVING THE EFFICIENCY OF STIRLING CYCLE HEAT MACHINES

(76) Inventor: Graham William Osborne, North Walsham (GB)

( * ) Notice: Subject to any disclaimer, the term of this patent is extended or adjusted under 35 U.S.C. 154(b) by 430 days.

(21) Appl. No.: 13/876,585

(22) PCT Filed: Oct. 3, 2011

(86) PCT No.: PCT/GB2011/051876

§ 371 (c)(1),
(2), (4) Date: Mar. 28, 2013

(87) PCT Pub. No.: WO2012/042281

PCT Pub. Date: Apr. 5, 2012

(65) Prior Publication Data

US 2013/0192221 A1 Aug. 1, 2013

(30) Foreign Application Priority Data

Oct. 1, 2010 (GB) ..... 1016522.3

(51) Int. Cl.
*F02G 1/00* (2006.01)
*F02G 1/044* (2006.01)
(Continued)

(52) U.S. Cl.
CPC ..... *F02G 1/00* (2013.01); *F01K 25/00* (2013.01); *F02G 1/043* (2013.01); *F02G 1/045* (2013.01); *F02G 2270/95* (2013.01)

(58) Field of Classification Search
CPC ..... F02G 1/043; F02G 1/044; F02G 1/045; F02G 1/06; F02G 2270/95; F02G 2253/80; F02G 2243/34
(Continued)

(56) References Cited

U.S. PATENT DOCUMENTS 1,056,746 A * 3/1913 Pitts ..... 74/52
2,390,229 A * 12/1945 Thompson ..... 74/52
(Continued)

FOREIGN PATENT DOCUMENTS

| | | |
|---|---|---|
| EP | 2006524 A2 | 12/2008 |
| GB | 758140 | 9/1956 |
| GB | 1315889 | 5/1973 |

*Primary Examiner* — Laert Dounis

(74) *Attorney, Agent, or Firm* — Renner Kenner Greive Bobak Taylor & Weber

(57) ABSTRACT

A heat machine having an external heat source and an external heat sink may be configured as a Stirling engine having a hot pair of cylinder-and-displacer combinations 15 and a cold pair of cylinder-and-displacer combinations 16 though advantageously two pairs of hot combinations 15 and two pairs of cold combinations 16 are provided, arranged mutually at right angles. Mechanisms 20 associated with the hot and cold displacers controls the movement thereof to be truly sinusoidal and are contained within casings 21. The pressure in the working fluid spaces remote from the mechanisms 20 and also the pressure in the casings 21 is monitored and compared, and then is controlled such that the casing pressure is slightly less than the minimum working fluid pressure in the working fluid spaces. The relative phase of the two mechanisms 20 associated respectively with the hot displacers and the cold displacers is adjustable (28,29,30,31; and FIG. 4).

33 Claims, 22 Drawing Sheets

(51) Int. Cl.

| | |
|---|---|
| ***F02G 1/053*** | (2006.01) |
| ***F01K 25/00*** | (2006.01) |
| ***F02G 1/043*** | (2006.01) |
| ***F02G 1/045*** | (2006.01) |

(58) Field of Classification Search
USPC ..... 60/516–518, 525, 526; 74/70, 84 B, 112, 74/117, 835, 116, 390, 571.11, 49, 570.1
See application file for complete search history.

(56) References Cited

U.S. PATENT DOCUMENTS 2,564,363 A * 8/1951 Horowitz et al. ..... 60/525
2,781,632 A * 2/1957 Meijer ..... F02G 1/05 123/196 CP
2,949,013 A * 8/1960 Doble ..... F01B 17/04 60/657
3,157,024 A * 11/1964 Wilkinson et al. ..... 60/525
4,004,421 A * 1/1977 Cowans ..... F02G 1/02 123/1 R
4,074,530 A 2/1978 Polster
4,240,256 A 12/1980 Frosch
4,257,230 A * 3/1981 Lundholm ..... F02G 1/0535 60/517
4,428,197 A * 1/1984 Liljequist ..... F01B 9/02 60/517
5,085,054 A * 2/1992 Katsuda ..... F02G 1/044 60/517
5,465,579 A * 11/1995 Terada ..... F02G 1/043 60/520
5,865,060 A * 2/1999 Osborne ..... 74/49
7,581,393 B2 * 9/2009 Yaguchi et al. ..... 60/521
7,644,581 B2 * 1/2010 Yaguchi et al. ..... 60/517
2005/0274111 A1 * 12/2005 Yaguchi ..... F01N 5/02 60/520
2008/0163620 A1 * 7/2008 Yaguchi et al. ..... 60/517
2008/0282693 A1 * 11/2008 Hoshino et al. ..... 60/517
2010/0186405 A1 * 7/2010 Conde ..... F02G 1/043 60/526
2014/0230428 A1 * 8/2014 Komori ..... F02G 1/045 60/517

* cited by examiner

VIEW A-A

VIEW B-B

ASSEMBLY -INTERNAL GEARS
FIXED IN RELATION TO CASE
GEAR RATIO 2/1

IMPROVING THE EFFICIENCY OF STIRLING CYCLE HEAT MACHINES

This invention concerns a heat machine arranged to operate with an external heat source and an external heat sink, and also to a method of operating such a heat machine. In particular, though not exclusively, this invention relates to Stirling engines (as defined herein), though various aspects of this invention may find application to other reciprocating displacer machines.

In the following, this invention will be described primarily with reference to heat engines operating on cycles approximating to the Stirling cycle, and such engines will be referred to as "Stirling engines", though it is to be understood that the invention is not limited to such engines. Moreover, when describing a Stirling engine it is to be understood that no practical Stirling engine can operate strictly on the Stirling cycle.

A Stirling engine is a heat engine deriving that heat from an external source. Often, a Stirling engine takes the form of an external combustion engine, but may use other heat sources such as waste heat from another process, or heat from isotopes, the sun or the like. A Stirling engine operates by cyclic compression and expansion of a working fluid in such a way that there is a net conversion of heat energy to mechanical work. The transfer of heat from the heat source (usually a combustion process) to the working fluid in a hot displacer-and-cylinder combination is through the walls of that combination, as is the transfer of heat from the working fluid to a heat sink in a cold displacer-and-cylinder combination.

Mostly, the displacer takes the form of a conventional circular piston working within a bore formed in a cylinder though the displacer could take other forms such as a diaphragm. For convenience throughout this specification reference will be made to engines having a displacer in the form of a piston sliding in a cylinder, but it is to be understood that the term "piston" should be interpreted broadly and so encompass other kinds of displacer. The engine includes a mechanism to cause reciprocating movement of the displacer, and mostly that mechanism has a rotary output shaft by means of which mechanical energy may be extracted from the engine.

In a Stirling engine, the working fluid is normally a gas which is compressed in the colder piston-and-cylinder combination and is expanded in the hotter piston-and-cylinder combination, the compression and expansion taking place by the movement of the pistons within the cylinders. The pistons are coupled to associated crankshafts to achieve the required reciprocating movement thereof and though frequently conventional crankshafts are employed these can have disadvantages. A crankshaft needs to be contained within a relatively large volume for a given working fluid displacement, hence leading to structural problems when the crankcase is pressurised. Also, the piston motion with a crankshaft is less than ideal and performance improvements can be achieved with other kinds of mechanism for connecting rotating and reciprocating components, such as an eccentric mechanism which is capable of producing true sinusoidal motion of the piston. Such mechanisms are employed in specific embodiments of this invention.

It is well known to improve the efficiency of a Stirling engine by employing a regenerator for the working fluid transferring between the hot and cold piston-and-cylinder combinations. A regenerator is a temporary heat store disposed internally of the engine in the path of the working fluid between the hot and cold chambers of the respective piston-and-cylinder combinations. The regenerator retains within the overall system heat which otherwise would be lost to the environment at a temperature between the maximum and minimum cycle temperatures. In this way, the thermal efficiency may approach the limiting value defined by these maximum and minimum temperatures of the cycle.

As a regenerator increases the thermal efficiency, this allows a higher mechanical power output from the engine for a given set of heat exchangers associated with the hot and cold piston-and-cylinder combinations. Conversely, there are losses associated with the incorporation of a regenerator in a Stirling engine and these can be significant. The regenerator increases the unswept volume of the piston-and-cylinder combinations and there are also pumping losses for the working fluid passing through the regenerator. If designed with care, a regenerator can still increase the overall efficiency of the system, as a whole.

Though Stirling engines have been known for nearly 200 years, there has been only very limited commercial take-up of such engines, and they are often regarded as novelty items. Problems associated with Stirling engines include: lack of power density unless a highly pressurised working fluid is employed; sealing problems which become more significant the higher the pressure of the working fluid and also when sliding seals are employed, especially if the crank space is not pressurised; structural weight; volume changes within the crank space if pressurised; heat shunt by the structure and by the crankcase fluid, from the hot piston-and-cylinder combination to the cold; a lack of controllability and especially the lack of rapid response to a change in power demand; the inability of the engine to operate over a wide range of rotational speeds; and a lack of a self-starting capability and reversibility. Further, a Stirling engine needs to reject more heat to the environment than a comparable internal combustion engine, and this leads to higher capital costs, weight and engineering complexity.

Research into Stirling engines has shown that the known designs suffer particularly from three problems. The most important of these is leakage of the working fluid past the seals of the engine, and particularly from the working space (that is, the space within the cylinder on the side of the piston remote from the crank mechanism) into the crank space. It is known to pressurise the crank space in an attempt to reduce that leakage but then there will be pumping losses within the crank space caused by the reciprocating motion of the pistons. The problems of leakage with a Stirling engine can be differentiated from those of an internal combustion engine because on each working cycle of an internal combustion engine, by virtue of the induction of a fresh charge of the working fluid for each power cycle, the conditions within the engine are effectively reset, and the consequence of any leakage within a cycle are restricted to that cycle. As the consequences of leakage are not carried forward to the next cycle, there is no adverse effect on the starting conditions of the next working cycle. By contrast, with an external heat engine having a fixed charge of working fluid, any deleterious effect of normal operation, such as working fluid leakage, is not compensated for within the normal operation and so the effect is cumulative. This leads to a rapid decline in the performance of the engine. Progressive wear over the working life of the engine significantly compounds the problem associated with leakage.

This invention has resulted from research into and development of known forms of Stirling engine, bearing in mind the above known issues of existing external combustion heat engines. Taking as a starting point, the mechanism described in my earlier WO96/23991 (granted as EP-0807219-B) has been developed so as to be capable of operating as a Stirling engine, and in the course of that, further aspects and improvements of the mechanism have been realised, as will be apparent from the following description of the inventive concepts and specific embodiments.

According to one aspect of this invention, there is provided a heat machine operating with an external heat source and an external heat sink and having:

- a first pair of displacers provided on a common first mount and working in opposed first bores formed in first cylinders;
- a first casing enclosing a volume between the first pair of displacers;
- a second pair of displacers provided on a common second mount and working in opposed second bores formed in second cylinders;
- a second casing enclosing a volume between the second pair of displacers;
- a mechanism interconnecting the first and second mounts and arranged to maintain a phase angle between the first and second pair of displacers; and
- working fluid chambers defined by the spaces in the cylinders on the sides of the displacers remote from the mounts, wherein means are provided to monitor and compare the pressure in said casings and in said chambers, and there is provided means to adjust one or both of the casing and working fluid pressures dependent upon the result of the comparison.

According to a second but closely related aspect of this invention, there is provided a method of operating a heat machine with an external heat source and an external heat sink, the machine having:

- a first pair of displacers provided on a common first mount and working in opposed first bores formed in first cylinders;
- a first casing enclosing a volume between the first pair of displacers;
- a second pair of displacers provided on a common second mount and working in opposed second bores formed in second cylinders;
- a second casing enclosing a volume between the second pair of displacers;
- a mechanism interconnecting the first and second mounts and arranged to maintain a phase angle between the first and second pair of displacers; and
- working fluid chambers defined by the spaces in the cylinders on the sides of the displacers remote from the mounts;
- in which method heat from the external heat source is supplied to the working fluid in the working fluid chambers adjacent the first pair of displacers, heat from the working fluid in the working fluid chambers adjacent the second pair of displacers is dumped to the external heat sink, the pressures in said casings and in said working fluid chambers are monitored and compared, and the pressure of fluid in one or both of the casings and chambers is adjusted dependent upon the result of the comparison.

As has been described above, leakage of the working fluid past a displacer in a heat engine will lead to greatly reduced efficiency. In part, there is a loss of heat consequent upon the loss of heated fluid by leakage and it is necessary to replenish the lost fluid. That must be done at the operating pressure of the engine and so requires the expenditure of work to drive the fluid into the chambers of the machine.

By having a substantially closed and pressurised casing for the interconnecting mechanism, and controlling the pressure in that casing to be related to (and preferably slightly less than) the sensed pressure in the working fluid chamber on the side of the displacer remote from the casing, the leakage past the displacer can greatly be reduced. Optimally, the pressure in the casing is maintained at a value of not more than, and preferably slightly less than, the pressure in the working fluid chamber though in practice the pressure in the working fluid chamber will be varying cyclically and it may not be possible for the casing pressure accurately to track the pressure in the working fluid chamber. As such, the casing pressure should be maintained at slightly less than the minimum pressure in the working fluid chamber.

By maintaining the casing pressure at below the minimum working fluid pressure, leakage occurs only from the working space into the casing, thus mitigating any movement of oil from the casing spaces to the working spaces. By maintaining the casing pressure to slightly below the minimum pressure in the working fluid, leakage of the working fluid can be minimised. It can be seen that in this invention, if the casing pressure rises due to leakage past the displacer seals and also consequent upon any temperature rise within the casing, fluid is moved out of the casing to maintain the casing pressure at the required value. Also, if the working fluid pressure drops due to leakage past the displacers, fluid can be moved into the working fluid space. The trigger for these fluid movements may be the lowest working space transient pressure when the machine is in operation.

The relative pressures to each side of the displacer may be small compared to the absolute pressure in the working space so that there is only a small pumping requirement to move working fluid from the casing space to the working space. Relatively small reservoirs for low-pressure and high-pressure working fluid may be provided. Preferably a filter is arranged to remove oil from fluid withdrawn from the casing, before the fluid is returned to the working space.

The monitoring and pressure adjustment may be achieved purely mechanically by having automatically operating valve arrangements. In this way, it is possible to achieve stable control of the working fluid pressure and casing pressure. In the alternative, this may be obtained electronically or electro-mechanically, perhaps using a computerised system.

Conventionally, pistons are sealed to cylinder walls by means of rings mounted in grooves formed circumferentially around the head of a piston. With the displacers of this invention taking the form of conventional pistons and with the casing pressure being maintained at just less than the minimum working fluid pressure, such ring seals may be sufficient to minimise working fluid leakage into the casing. It has been proposed to use a known form of annular rolling seal between the displacer and the cylinder, in which a highly flexible annular diaphragm has its inner periphery sealed to the displacer and its outer periphery sealed to the cylinder wall. On account of the working conditions, and in particular the temperatures and pressures prevailing in a Stirling engine, such rolling seals have been found wholly impractical and fail very quickly.

In order to facilitate the maintenance of the required pressure in the casing, it is advantageous to reduce the volume of the casing as much as possible. If the mechanism interconnecting each displacer (piston) with an output shaft is in the form of a conventional crankshaft and connecting rod, a relatively large volume is required within the casing to accommodate that mechanism. Moreover, there will be variations in the volume within the casing as the displacers are moved by the mechanism.

The above problems may be addressed by providing a mechanism in the form described in WO 96/23991, employing eccentrics connected to the mounts for the displacers. This mechanism has the advantage of producing true sinusoidal motion in the displacers and moreover the mechanism may be contained within a casing having a very small internal volume. These measures together facilitate the maintenance of the pressure within the casing to the required value.

Advantageously, means are provided to maintain the pressures in the first and second casings substantially the same and this may be achieved by having a pipe or duct extending between those casings. Alternatively, the first and second casing could be integrated into a single casing.

A preferred form of heat machine of this invention has: a third pair of displacers provided on a common third mount and working in opposed third bores formed in third cylinders; a third casing enclosing a volume between the third pair of displacers; a fourth pair of displacers provided on a common fourth mount and working in opposed fourth bores formed in fourth cylinders; a fourth casing enclosing a volume between the fourth displacers; and a mechanism interconnecting the third and fourth mounts and arranged to maintain a phase angle between the third and fourth pairs of displacers, the mechanism associated with the third and fourth pairs of displacers being arranged to maintain a phase angle with respect to the first and second pairs of displacers, such as shown in FIG. 12A.

With this preferred form of machine, the first and third pairs of displacers may have directly linked interconnecting mechanisms disposed in a common casing (that is, the first and third casings are common) and the second and fourth pairs of displacers may have directly linked interconnecting mechanisms disposed in a common casing (that is, the second and fourth casings are common). When this preferred arrangement is arranged as a Stirling engine, the first and third displacer and cylinder combinations may serve as the hot combinations and the second and fourth displacer and cylinder combinations may serve as the cold combinations.

If the first and third casings are integrated into a single common casing and the second and fourth casings are integrated into a further single common casing, such as shown in FIG. 12B, means may be provided to maintain the pressures in the two common casings to be substantially the same and this may be achieved by having a pipe or duct extending between those casings. Alternatively, the first, second, third and fourth casings could all be integrated into a single common casing, such as shown in FIG. 12C.

By employing a mechanism which produces true sinusoidal motion of the displacers for each of the combinations, the volume within each casing will not change upon operation of the machine and the mean pressure within each casing may be maintained at the required value, just below the minimum pressure within the working space of the machine.

The preferred form of heat machine of this invention as described above has directly linked interconnecting first and second mechanisms respectively for the first and third pairs of displacers and for the second and fourth pairs of displacers. The first and second mechanisms advantageously are coupled together for synchronous operation in order to allow the machine to operate as a Stirling engine. The performance of such an engine may be enhanced by providing means to adjust the phase angle between the first and third pairs of displacers with respect to the second and fourth pairs of displacers, by adjustment of the relative phase of the first and second mechanisms. In addition, a Stirling engine provided with phase adjustment allows the starting characteristics of the engine to be improved by appropriate adjustment of the relative phase of the first and second mechanisms.

From the foregoing, it will be appreciated that in its most preferred form, this invention relates to a Stirling engine having hot and cold pairs of displacers, wherein there are:

- mechanisms controlling movement of the displacers which mechanisms produce essentially sinusoidal motion of the displacers thereby to maintain constant the volume within the casings for the mechanisms;
- adjustment means for the relative phase of the hot and cold pairs of displacers, by adjusting the phase of the two mechanisms respectively for the hot pairs of displacers and the cold pairs of displacers; and
- monitoring and control means for the pressure in the working fluid to the sides of the displacers remote from the mechanisms and for the pressure in the casings for the mechanisms.

It is known to control the power output of a Stirling engine by varying the working fluid pressure. In general, the greater the working fluid pressure, the higher the achievable power output but of course the maximum pressure is limited by other mechanical factors such as the strength of the engine housing and crank casings, seals and so on. The power output of a Stirling engine of this invention as just described above may also be controlled by varying the absolute pressure in the working fluid but in this case the pressure in the casings should also be varied in a corresponding manner, as defined by this invention.

By adopting all of the above measures, it becomes possible to produce a practical embodiment of a Stirling engine, able to self-start and then run efficiently to produce useful output work, with minimal leakage of working fluid past the seals of the displacers. This invention therefore extends to a method of operating such a Stirling engine, in which the pressure in the working fluid to both sides of the displacers is monitored and controlled, and also the relative phase of the hot and cold pairs of displacers is adjusted to optimise engine performance and also the direction of rotation.

By way of example only, certain specific embodiments of Stirling engine, reciprocating piston mechanisms and other engines and pumps constructed and arranged in accordance with the various aspects of this invention will now be described in detail, reference being made to the accompanying drawings in which:

FIGS. 1A, 1B and 1C are diagrammatic sectional views of a first embodiment, with FIGS. 1A and 1B taken on the section lines A-A and B-B marked on FIG. 1C of a Stirling engine having four hot piston-and-cylinder combinations and four cold piston-and-cylinder combinations;

FIG. 2A diagrammatically illustrates an alternative mechanism to change the phase of the hot and cold piston-and-cylinder combinations, as compared to the arrangement shown in FIG. 1;

FIGS. 2B and 2C respectively show side and end views of an adjustment slug used in the mechanism of FIG. 2A;

FIGS. 2D and 2E respectively show a cross-section through the end portion of the shaft and an end view thereof, of the mechanism of FIG. 2A;

FIG. 3 diagrammatically illustrates an electronic control arrangement for the fluid pressure within the engine of FIG. 1 but as modified by the phase control arrangement of FIG. 2;

FIG. 4 diagrammatically illustrates a mechanical control arrangement for the fluid pressure within the engine of FIG. 1 but as modified by the phase control arrangement of FIG. 2;

Figure 1A:
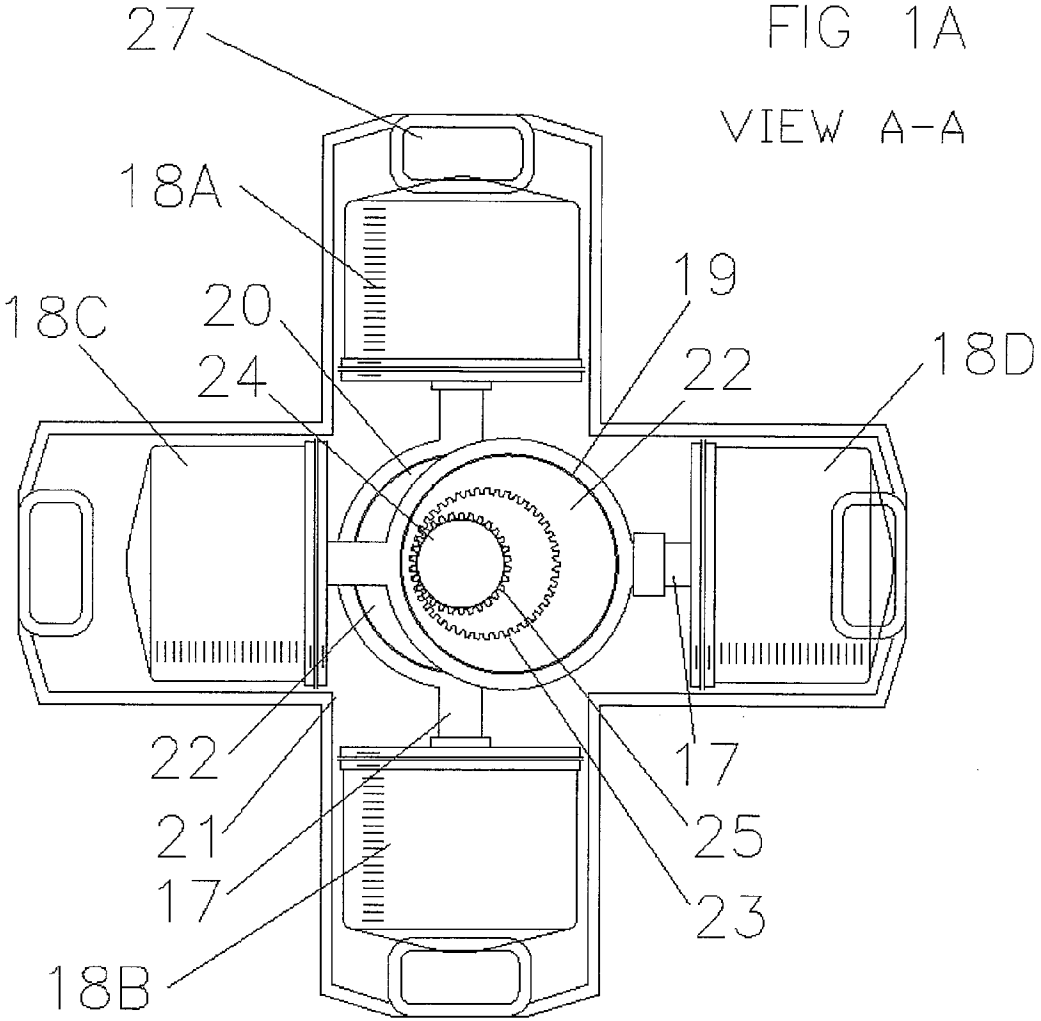
Figure 1B:
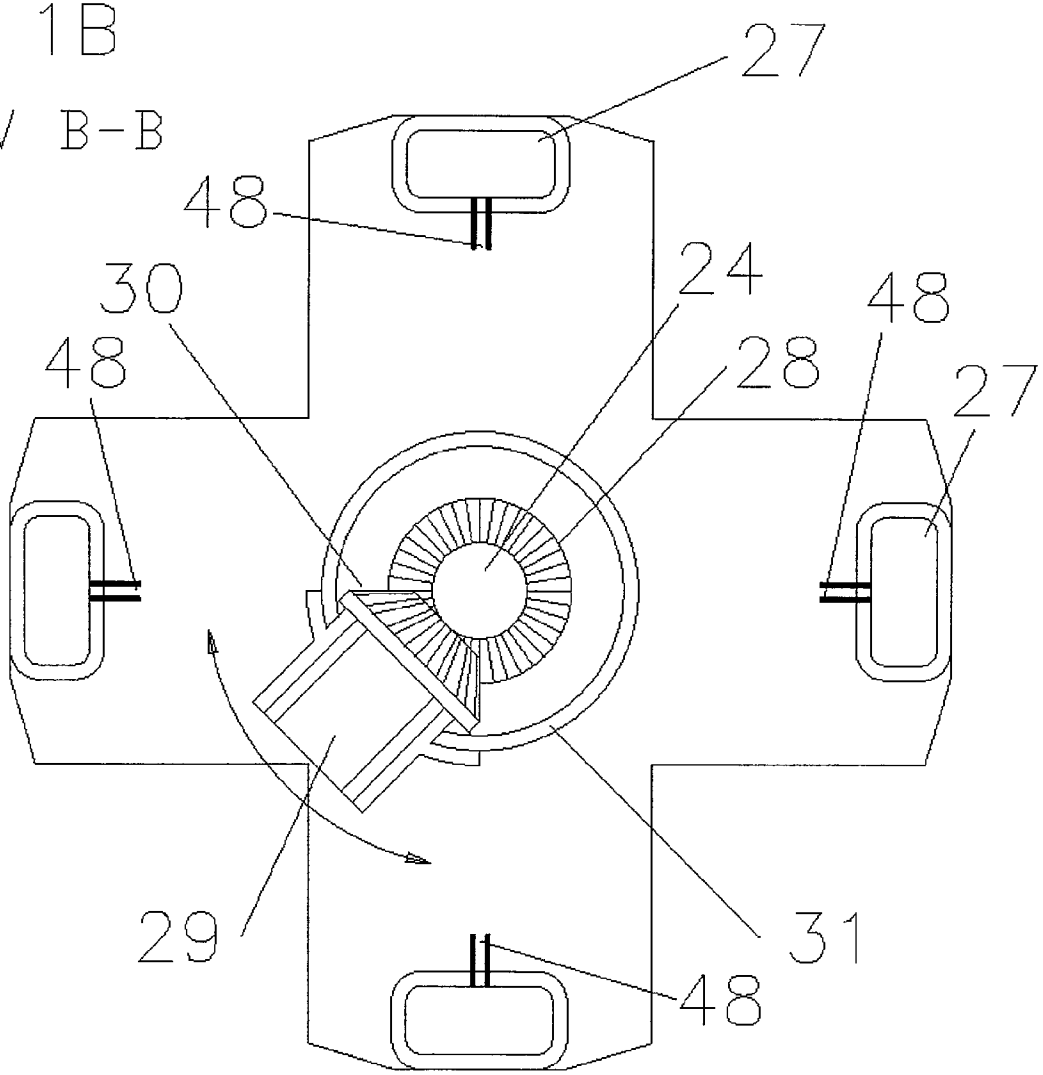
Figure 1C:
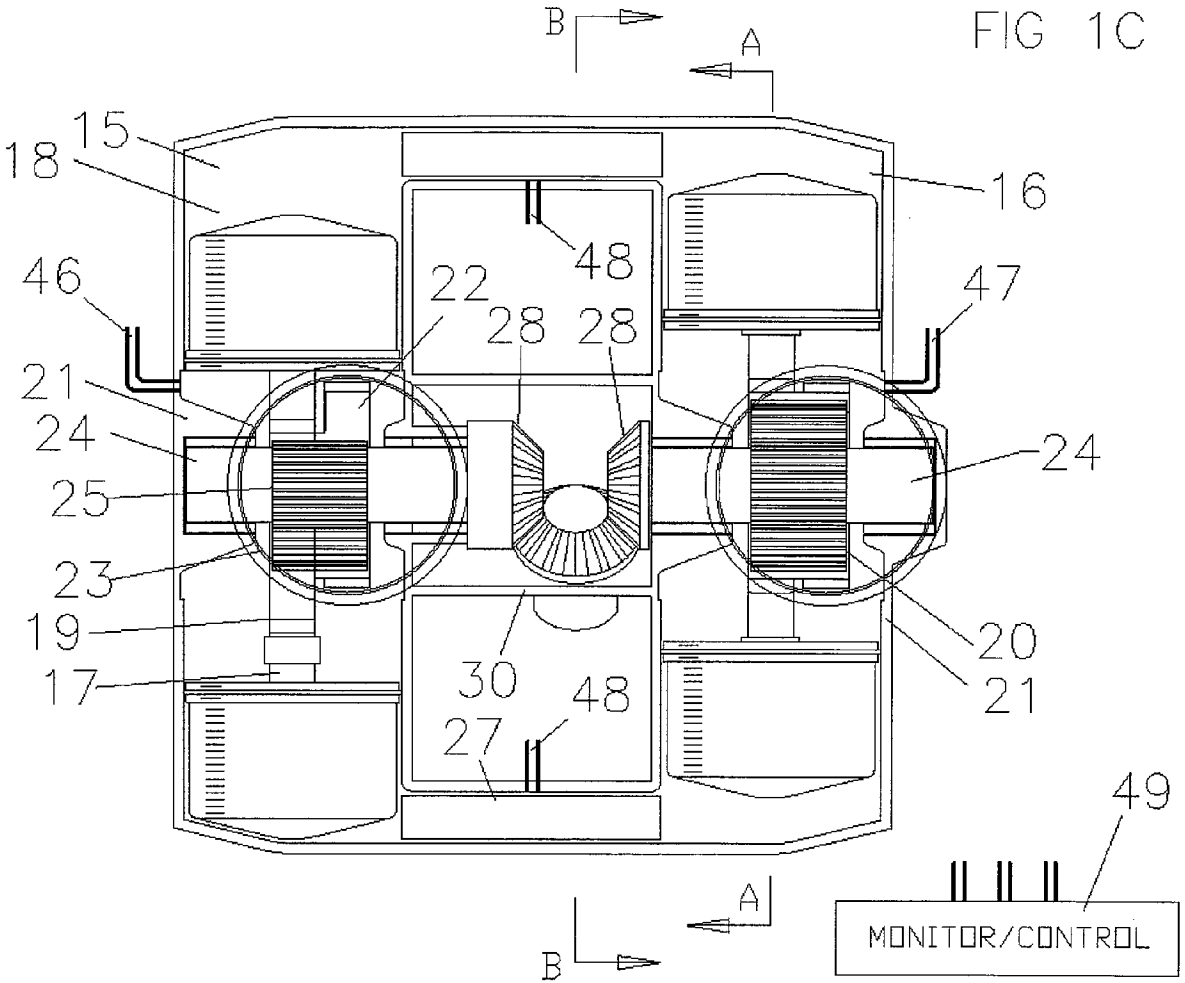
Figure 5B:
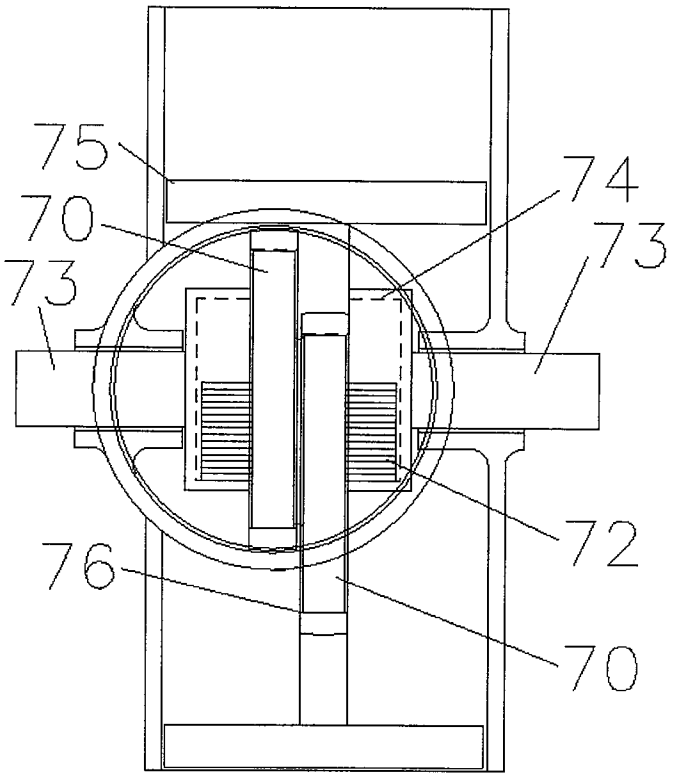
FIGS. 5A and 5B are respectively transverse and axial cross-sectional views of an alternative piston-and-cylinder combination with an alternative eccentric mechanism from that of FIG. 1.
Figure 5A:
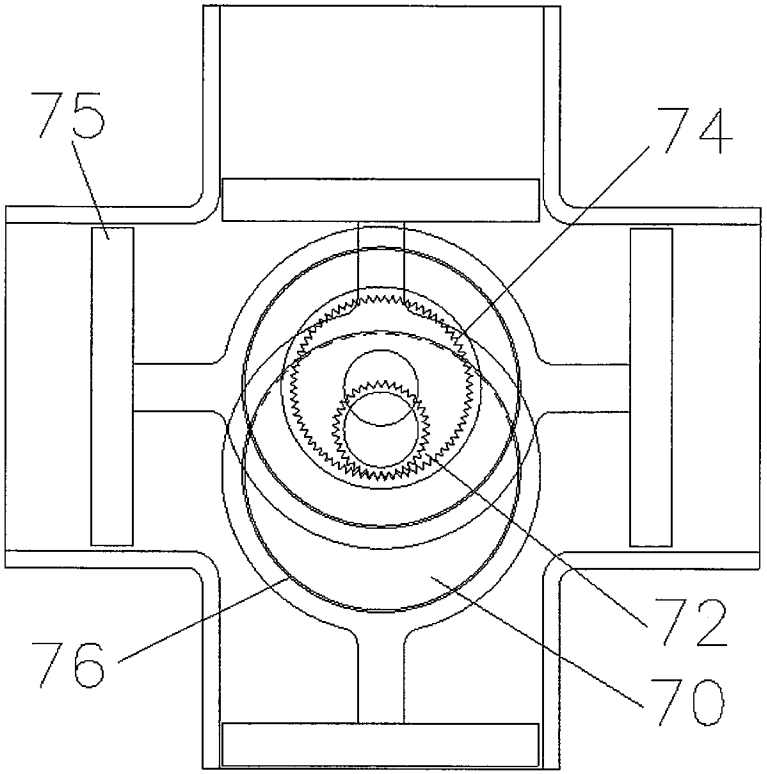
Figure 5C:
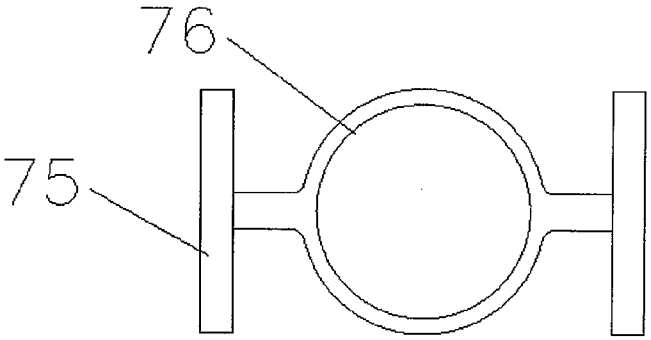
FIGS. 5C, 5D and 5E are third angle projections of a piston driver used in the eccentric mechanism of the engine of FIGS. 5A and 5B.
Figure 5D:
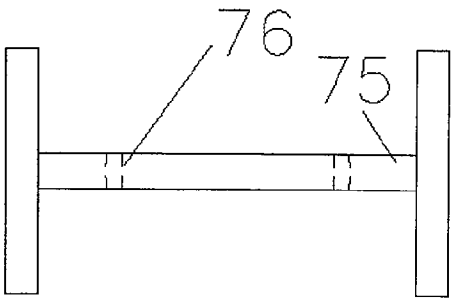
Figure 5E:
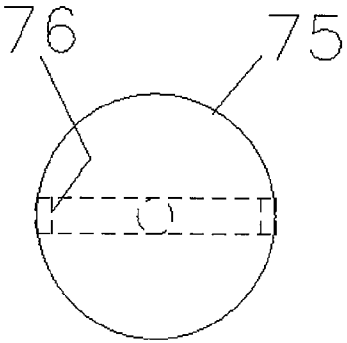
Figure 5F:
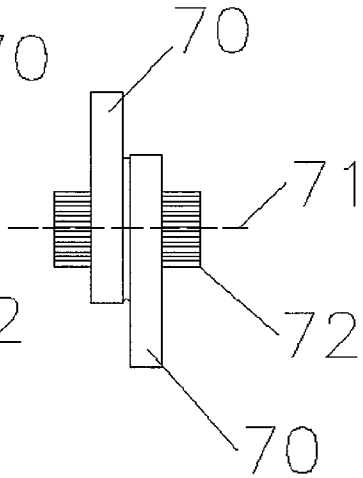
FIGS. 5F and 5G show axial and end views of an eccentric member used in the engine of FIGS. 5A and 5B.
Figure 5G:
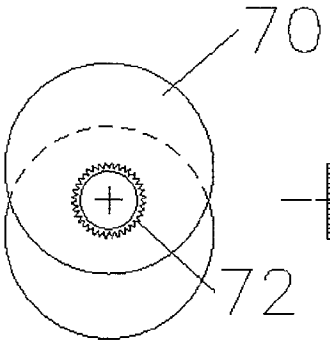
Figure 5J:
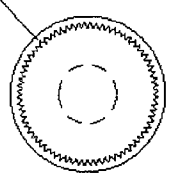
Figure 5H:
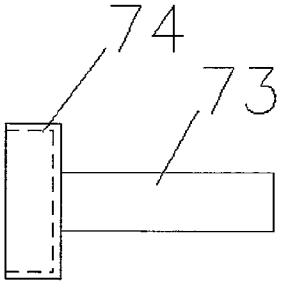
Figure 6C:
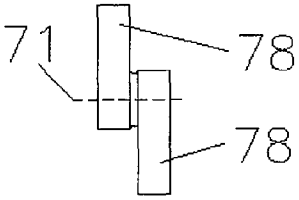
Figure 6B:
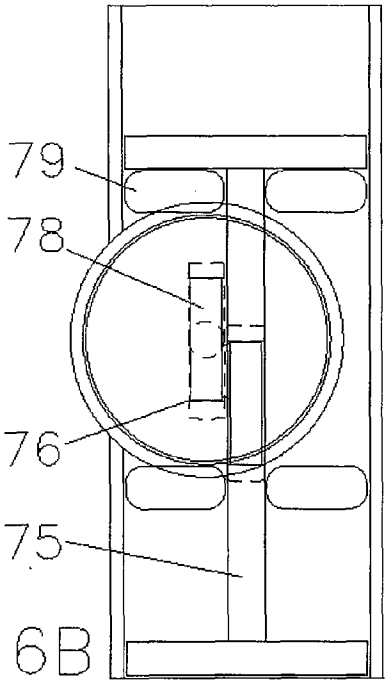
Figure 6D:
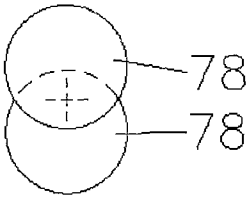
Figure 6A:
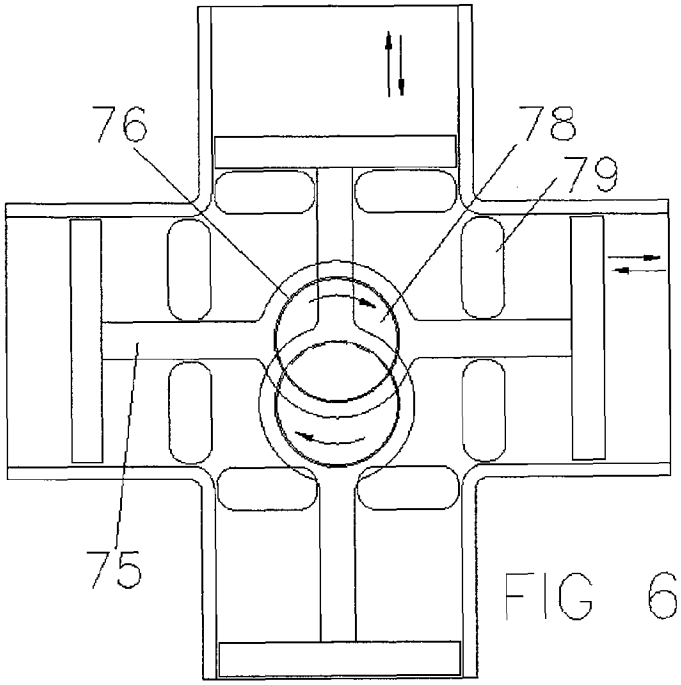
Figure 7B:
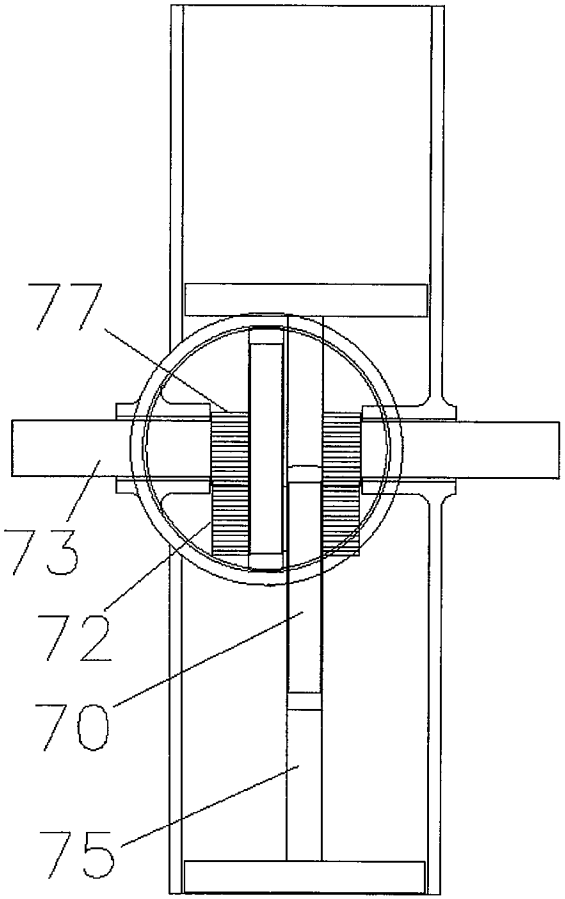
Figure 7A:
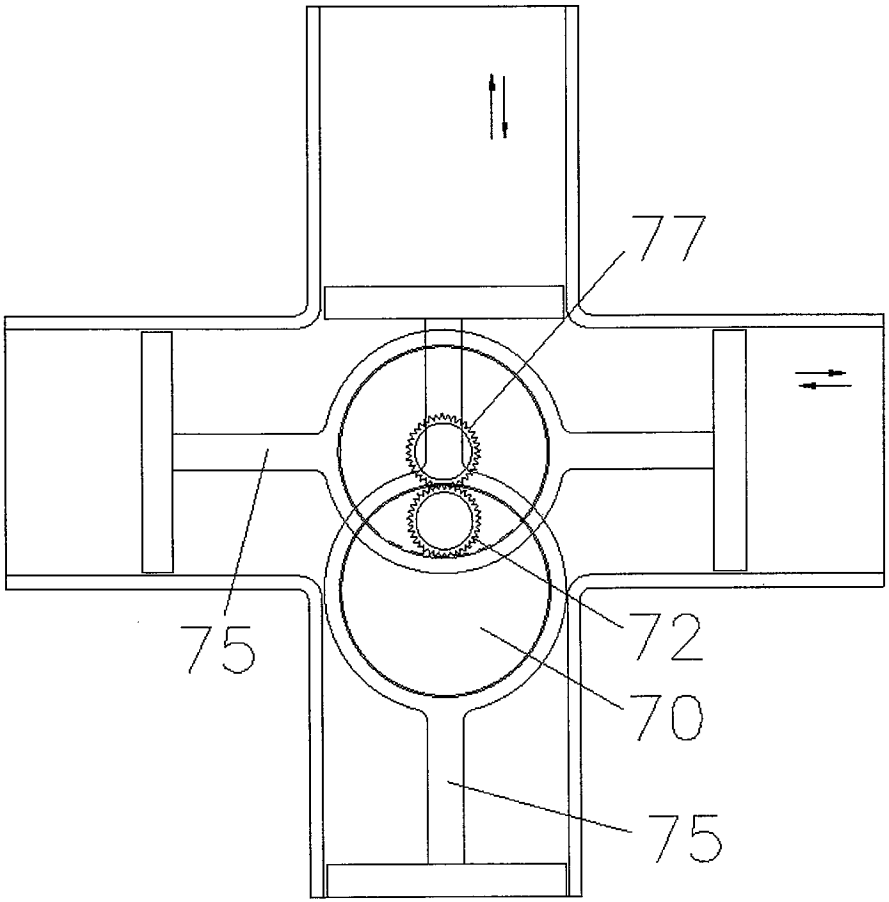
Figure 7E:
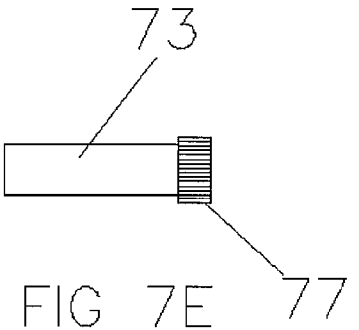
Figure 7F:
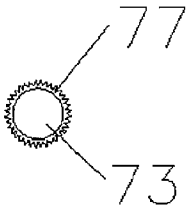
Figure 7J:
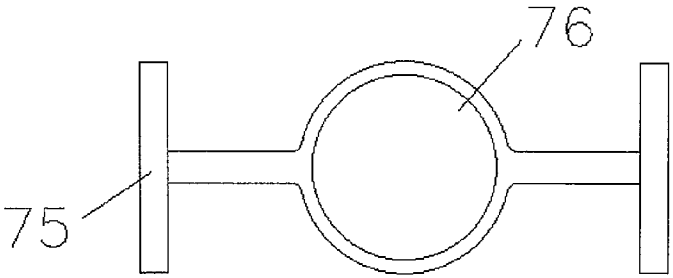
Figure 7G:
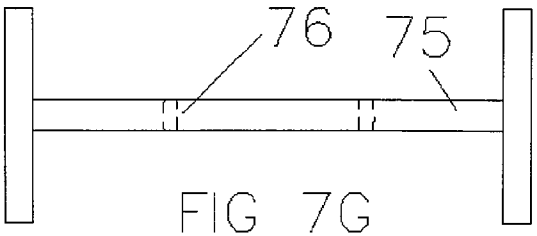
Figure 7C:
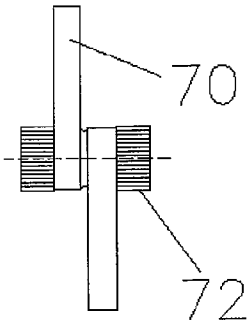
Figure 7D:
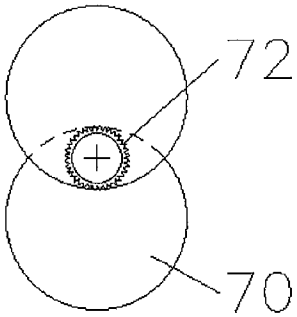
Figure 7H:
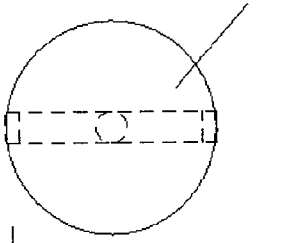
Figure 8B:
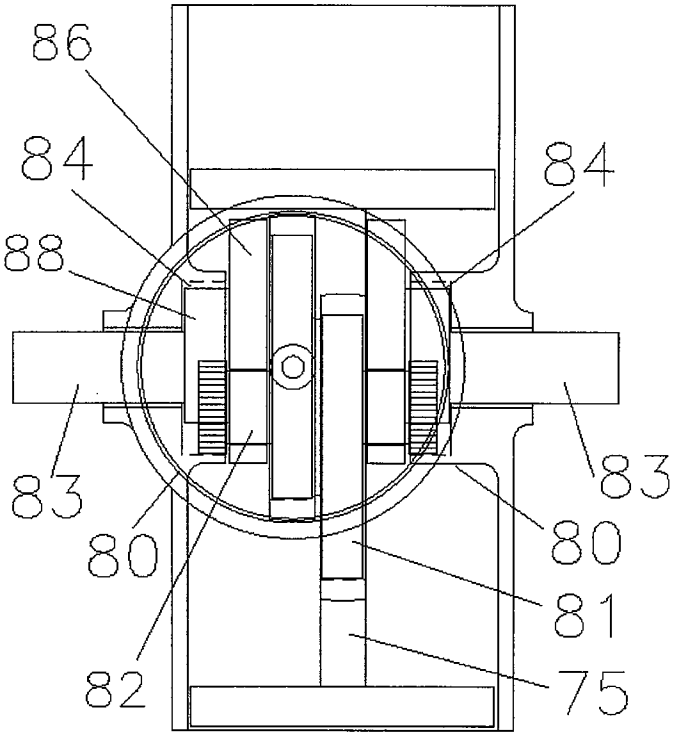
Figure 8A:
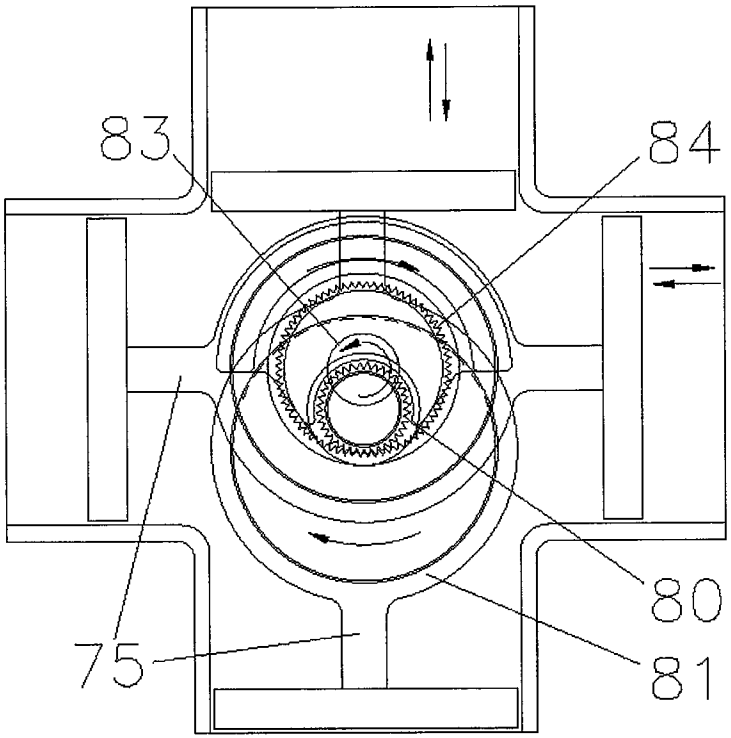
Figure 8F:
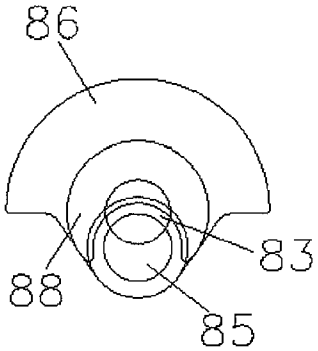
Figure 8D:
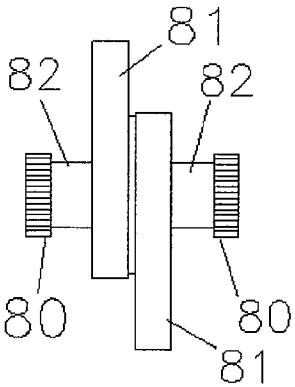
Figure 8E:
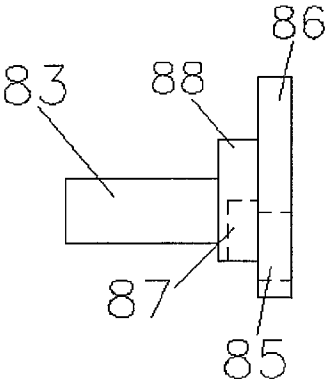
Figure 8C:
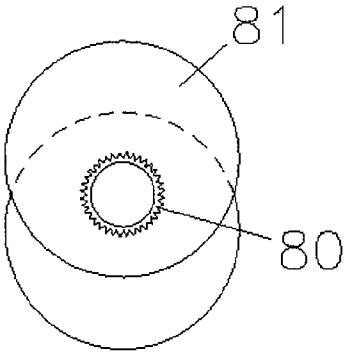
Figure 8G:
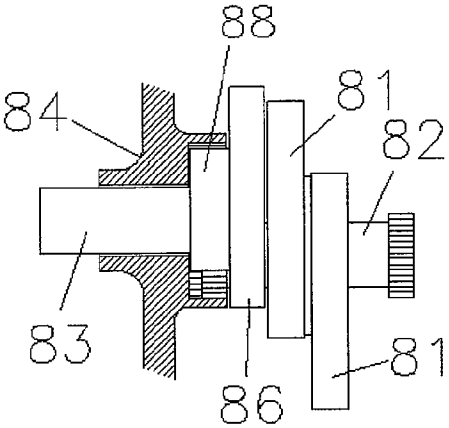
Figure 8H:
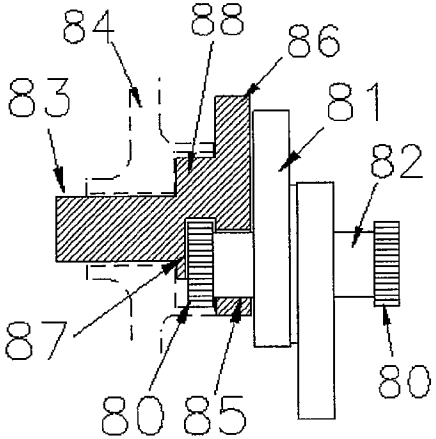
Figure 9B:
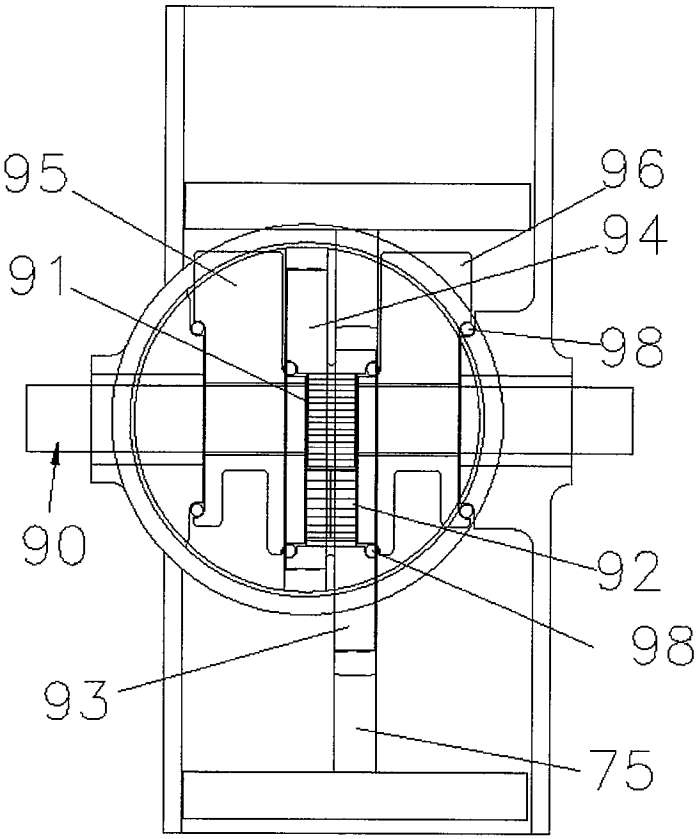
Figure 9A:
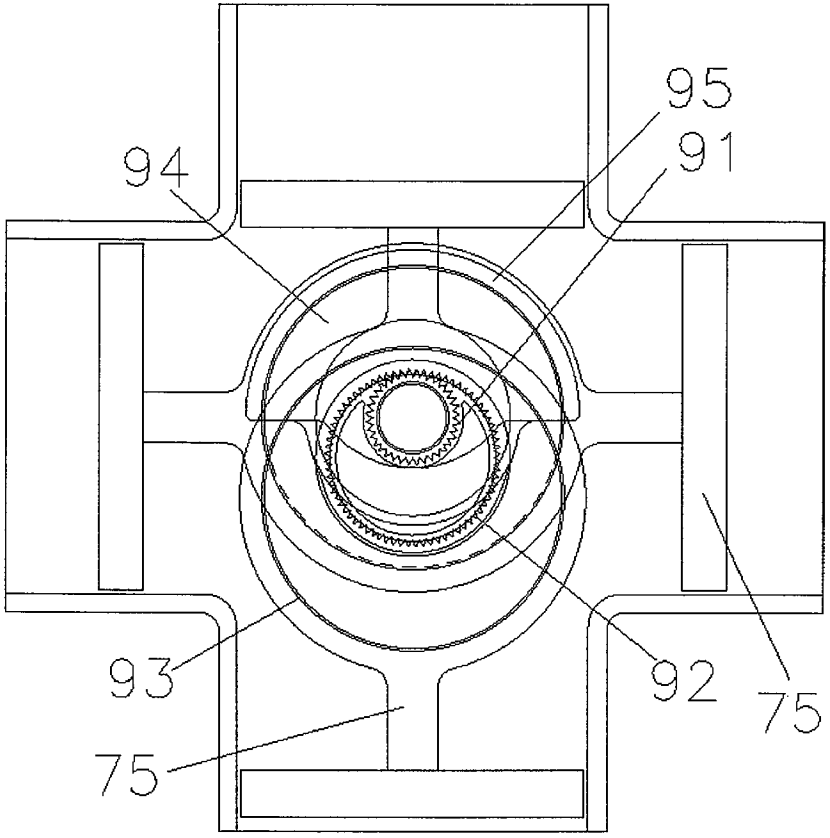
Figure 11B:
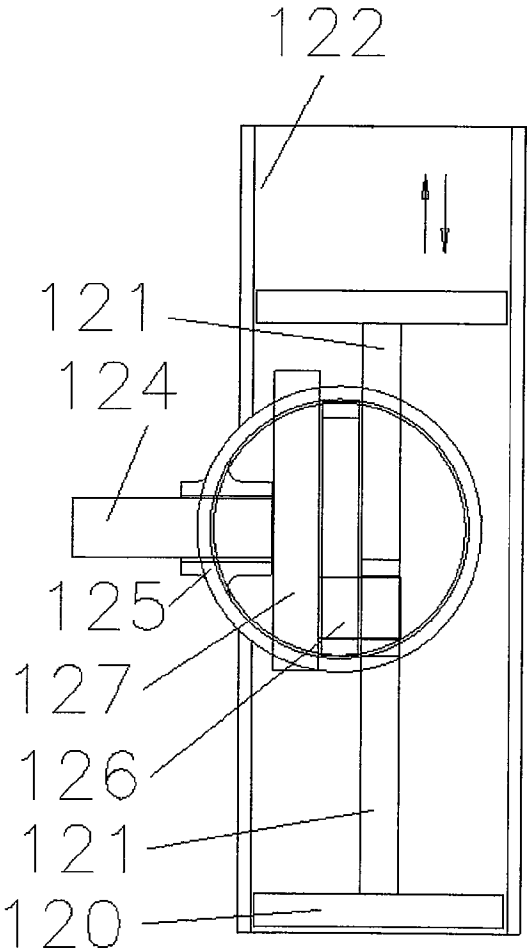
Figure 11A:
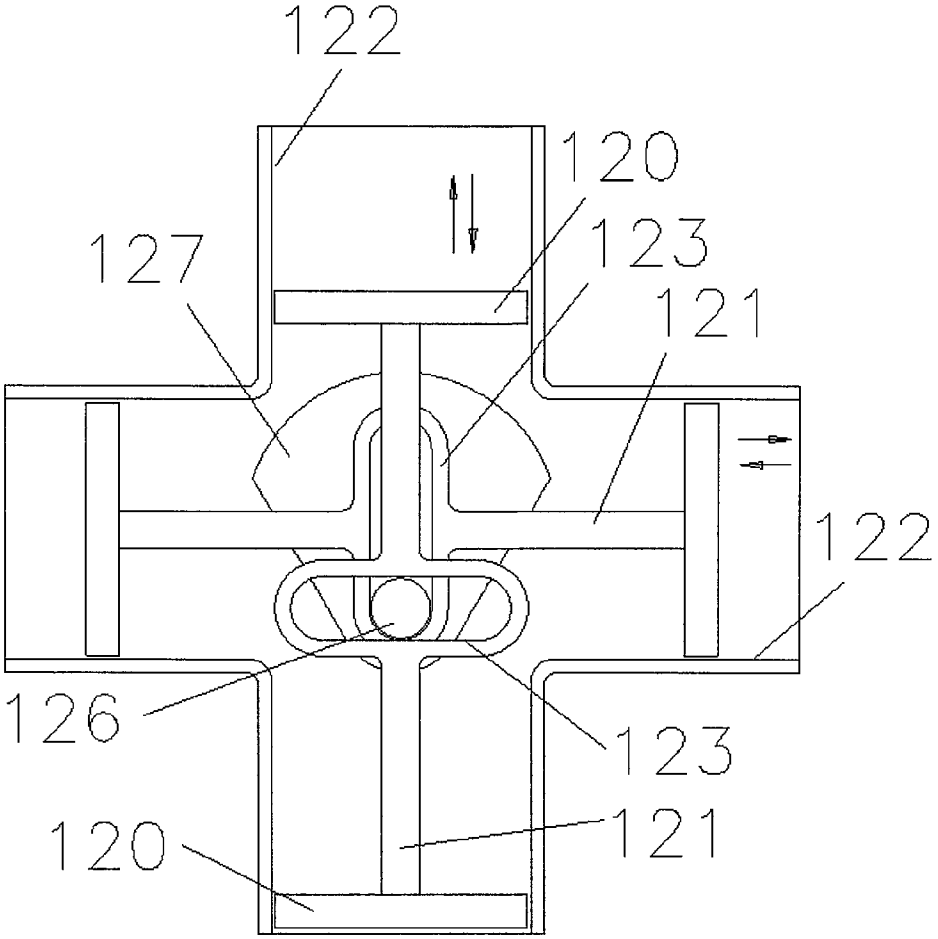

FIGS. 5H and 5J [to avoid confusion there is no FIG. 5I] show axial and end views of an output shaft used in the engine of FIGS. 5A and 5B;

FIGS. 6A and 6B are respectively transverse and axial cross-sectional views of an alternative piston-and-cylinder combination using an eccentric mechanism different from that of FIG. 1 and having no coupled output shaft;

FIGS. 6C and 6D show axial and end views of an eccentric member used in the engine of FIGS. 6A and 6B;

FIGS. 7A and 7B are diagrammatic sectional views of yet another arrangement having two sets of piston-and-cylinder combinations where both the output shaft and the eccentric mechanisms are provided with externally-toothed gears, FIGS. 7C and 7D being side and end views on the eccentrics, FIGS. 7E and 7F being side and end views on the output shaft, and FIGS. 7G, 7H and 7J [to avoid confusion there is no FIG. 7I] are third angle views of the sliding linear component used in the arrangement;

FIGS. 8A and 8B show a modified form of the arrangement of FIGS. 7A and 7B but with internal gears fixed to the crankcase and the eccentrics (FIGS. 8C and 8D) having external gears meshed with those fixed gears to give a 2:1 ratio and with the output shaft (FIGS. 8E and 8F) including a counterweight to balance the mechanism, FIG. 8G showing the interconnection of the gears in part sectional view and FIG. 8H showing that interconnection in further detail;

FIGS. 9A and 9B show a modified form of the mechanism of WO96/23991 but including a counterweight to improve the balance of the mechanism, FIGS. 9C, 9D, 9E and 9F showing detail views of the mechanism in both sectional and end views;

FIGS. 10A to 10E are views of a modified form of the mechanism of FIGS. 9A to 9F but including meshing external gears on the eccentrics and output shafts; and FIGS. 11A and 11B diagrammatically illustrate an alternative mechanism for connecting the pairs of displacers with an output shaft and which produces true displacer sinusoidal motion.

Figure 12A:
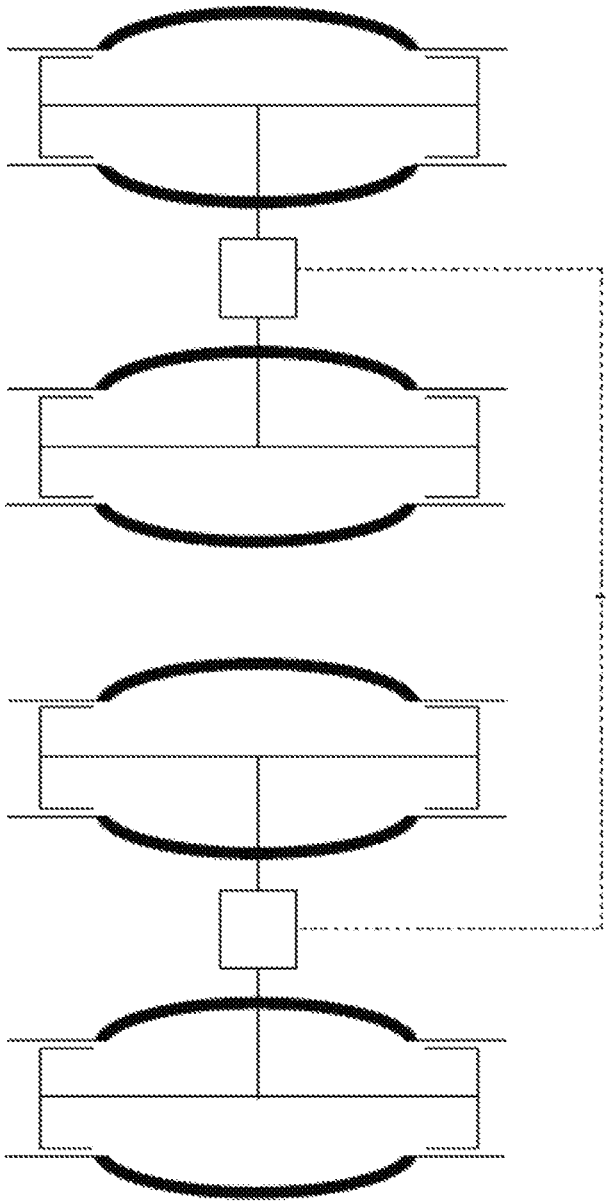

FIG. 12A shows a diagrammatic sketch of an embodiment of the present invention in which the heat machine includes four casings, one for each of the four pairs of displacers.

Figure 12B:
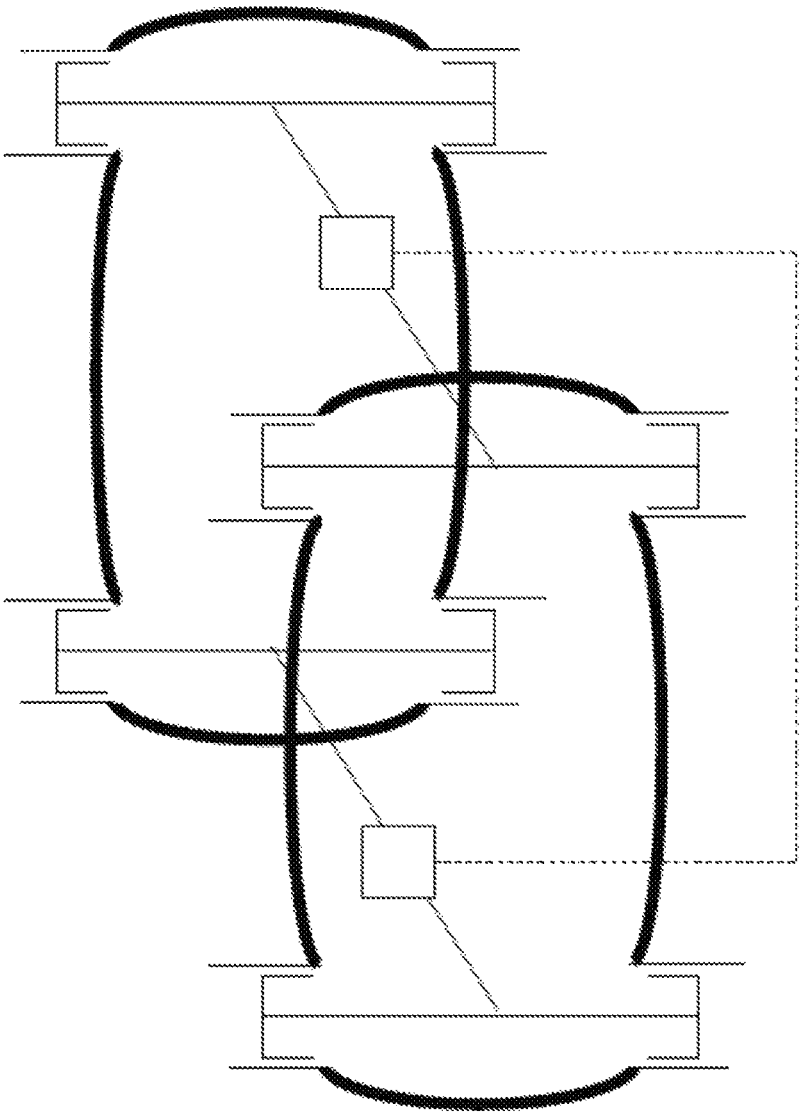

FIG. 12B shows a diagrammatic sketch of an embodiment of the present invention in which the first and third casings are integrated into a single common casing and the second and fourth casings are integrated into a further single common casing.

Figure 12C:
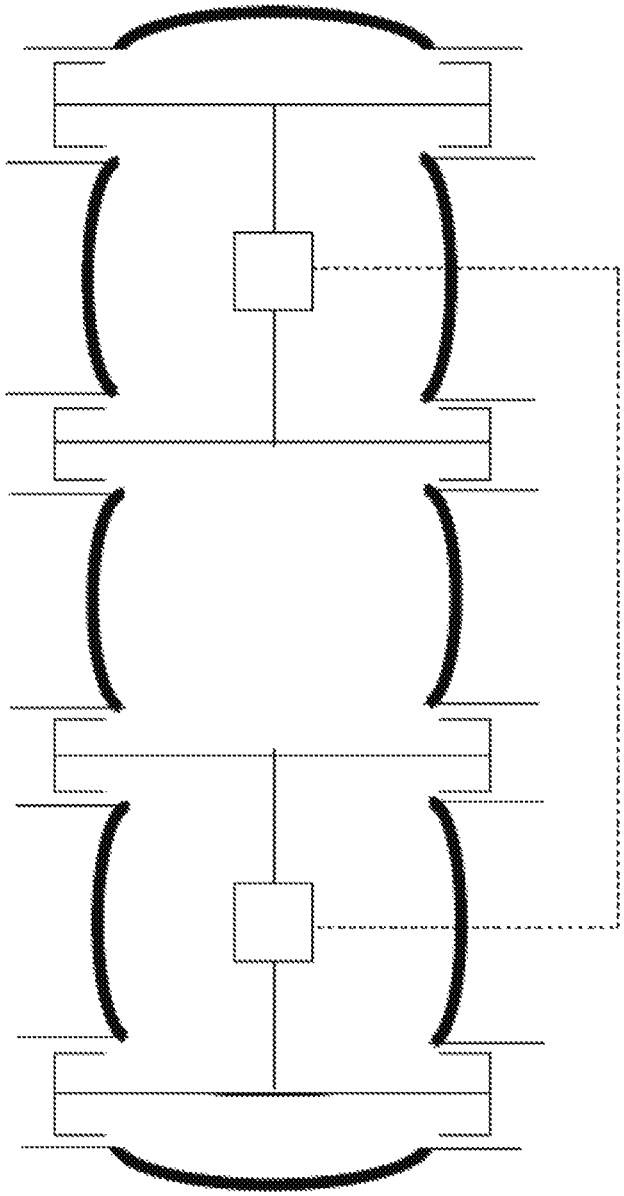

FIG. 12C shows a diagrammatic sketch of an embodiment of the present invention in which the first, second, third and fourth casings are integrated into a single common casing.

The heat machines to be described hereinafter include mechanisms which are developments of the mechanism described in WO96/23991 aforesaid. Some of these machines are intended to operate as Stirling engines whereas others may operate as pumps requiring mechanical energy input in order to move fluids, and yet others may operate as electrical generators. Reference should be made to WO96/23991 for the basic operating principles of the eccentric mechanism which is incorporated in the machines described hereinbelow, either exactly as has been described in WO96/23991 or in modified forms.

Referring initially to FIGS. 1A, 1B and 10, there is shown a Stirling engine having a set of four hot piston-and-cylinder combinations 15 and a set of four cold piston-and-cylinder combinations 16, the piston-and-cylinder combinations in each set being disposed with an angular spacing of 90° of arc. In each set, there are two opposed piston-and-cylinder combinations with a rigid connecting element 17 extending between the pistons 18 of opposed pairs, each connecting element having a central circular opening 19. An eccentric mechanism 20 (as described in greater detail in WO96/23991) is rotatably arranged in a casing 21 carrying the cylinders of the piston-and-cylinder combinations and has respective eccentrics 22 received in the openings 19 of the connecting elements 17. The eccentrics 22 of each mechanism 20 are disposed 180° out of phase as may be appreciated from FIG. 1A, or from FIG. 5 (and particularly FIGS. 5F and 5G) which show an alternative eccentric mechanism.

As shown in FIG. 1A, rotation of the eccentric mechanism 20 has the pistons 18 of one pair operating at a phase angle of 90° to the pistons of the other pair; thus, when the pistons of one pair are disposed respectively at bottom dead centre and top dead centre (pistons 18C and 18D in FIG. 1A) the pistons of the other pair are both disposed at mid-stroke (pistons 18A and 18B).

The eccentrics 22 of each mechanism 20 are furnished with an internally-toothed bore 23 eccentric to the outer surface of the eccentrics 22 and which are received in the circular openings 19 of the connecting elements. An output shaft 24 is journalled in the casing 21 and has an externally-toothed gear 25 meshed with the internally-toothed bore 23 of the eccentrics. Rotation of the eccentrics around the output shaft 24 will cause rotation of that output shaft, allowing power to be extracted from the machine.

As mentioned above, the mechanism of FIG. 1 is configured as a Stirling engine—that is to say, an engine operating on a cycle which approximates to the Stirling cycle. The set of hot piston-and-cylinder combinations 15 is disposed within a heat exchanger (not shown) such that in use, heat supplied to that heat exchanger will be transferred to those piston-and-cylinder combinations 15. Similarly, the set of cold piston-and-cylinder combinations 16 is disposed within another heat exchanger (not shown) such that in use, heat may be extracted from those piston-and-cylinder combinations 16. Transfer ducts 27 for working fluid interconnect the aligned piston-and-cylinder combinations respectively of the hot and cold sets, there thus being four such transfer ducts 27 as best seen in FIG. 1B. Within each transfer duct there is a regenerator (not shown, but in a manner well known in the art), which in effect is a temporary heat store through which the working fluid passes during operation of the engine, as discussed above.

The general operation of a Stirling engine with the transfer of fluid between hot and cold piston-and-cylinder combinations, though not the mechanical arrangement described above, is well known within the field of Stirling engines and will not be described in more detail here.

In a so-called alpha Stirling engine, the pistons of the interconnected hot and cold cylinders making up one pair normally reciprocate at 90° out of phase though it is known to provide a mechanism to allow adjustment of the out-of-phase angle. In the arrangement of FIG. 1, the two output shafts 24 (of the hot and cold piston-and-cylinder combinations) are coaxially aligned and their confronting ends are furnished with bevel gears 28, there being a drive shaft 29 carrying a further bevel gear 30 meshed with gears 28. The drive shaft 29 is mounted on a carrier 31 which mounted for turning movement about the axis of the two output shafts 24. Angular adjustment of the position of the carrier 31 with respect to the casing 21 will adjust the phase of the two output shafts 24, which in turn will adjust the relative phases of the eccentric mechanisms 20 associated respectively with the hot and cold piston-and-cylinder combinations.

Figure 2A:
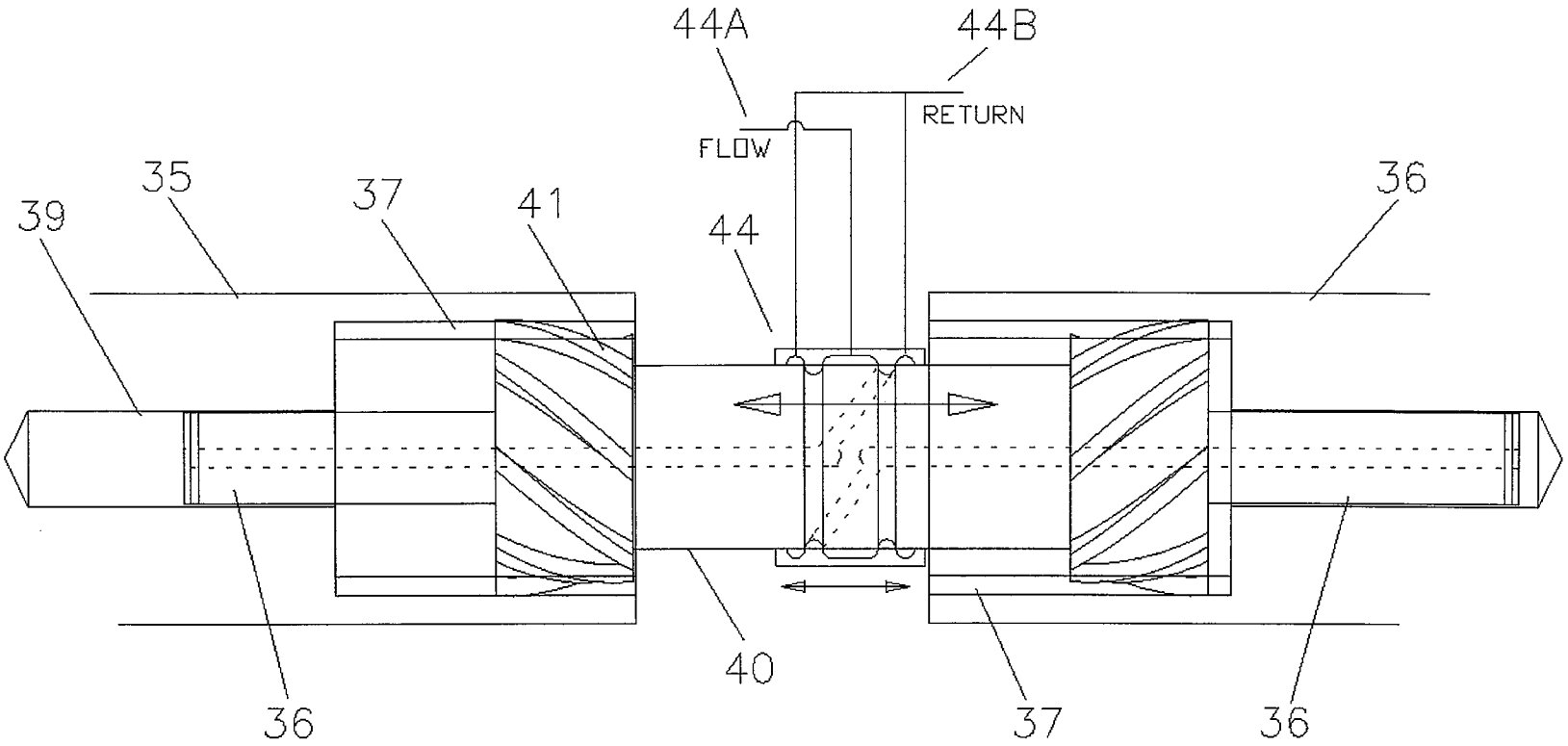
Figure 2B:
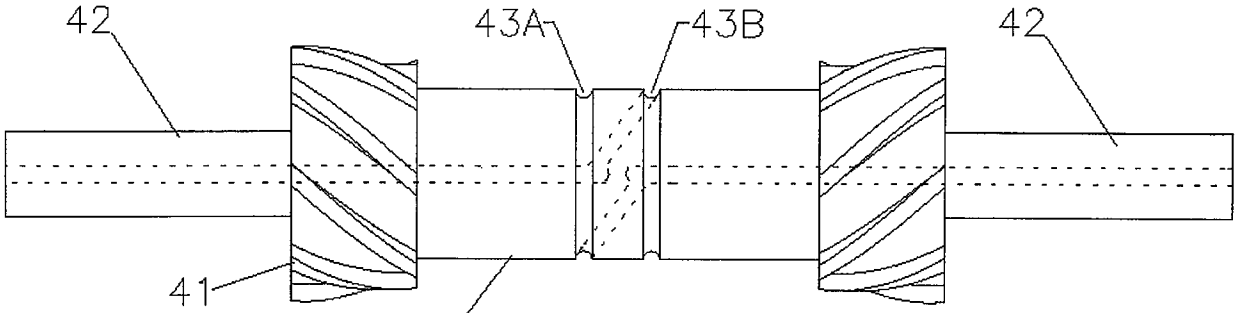
Figure 2C:
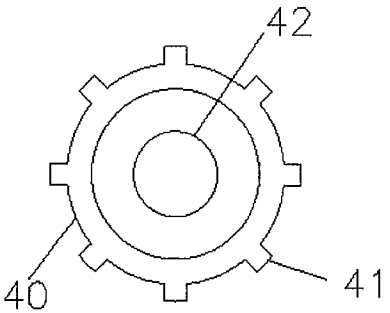

FIG. 2A illustrates an alternative mechanism to change the out-of-phase angle of the hot and cold piston-and-cylinder combinations and FIGS. 2B to 2E show the component parts of that alternative mechanism.

Figure 2D:
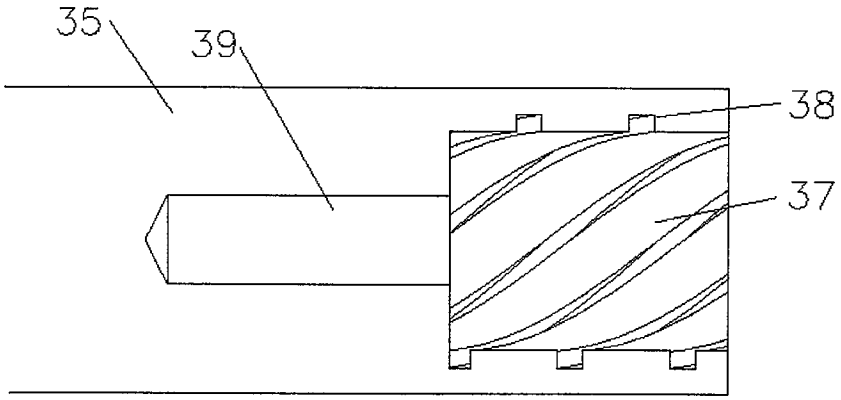
Figure 2E:
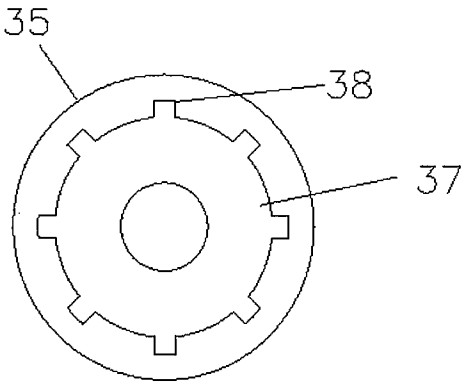

The two output shafts 35 and 36 (equivalent to the output shafts 24 of the FIG. 1 embodiment) have coarse-threaded bores 37 having square-section grooves 38 extending helically into the bores, as best seen in FIGS. 2D and 2E. The thread in the bore of the left-hand output shaft (in FIG. 2A) is right-handed and that in the right-hand output shaft is left-handed. The output shafts 35,36 each has a blind bore 39 extending axially deeper into the shaft, beyond the threaded part 37 thereof. An adjustment slug 40 (FIGS. 2B and 2C) has externally-threaded ends defined by helical ribs 41 arranged to co-operate respectively with the left and right-handed threaded bores of the two output shafts and the slug 40 has pistons 42 extending axially therefrom and received in the bores 39. Seals, such as O-rings, are provided at the free ends of the pistons 42.

Annular grooves 43A,43B are formed around the central region of the slug 40, groove 43A communicating with an axial passageway extending to the left (in FIG. 2A) of the slug and its piston 42 to open into the space between the end of the piston and the associated blind bore 39. Similarly, groove 43B communicates with an axial passageway extending to the right of the slug and its piston 42 to open into the space between the end of that piston and the associated blind bore. A valve member 44 is slidably mounted around the central region of the slug and a flow pipe 44A for fluid under pressure and return pipes 44B are connected to that valve member. A control arrangement for that valve member is provided so that the member may be moved axially with respect to the slug 40. In this way, fluid under pressure may be supplied either to the space between the blind bore and the piston to the left-hand side of the slug so as to move the slug to the right, or to the space between the blind bore and the piston to the right-hand side of the slug, so as to move the slug to the left. It will be appreciated that axial movement of the slug to the left or to the right causes the relative angle between the output shafts 35 and 36 to be changed, in view of the oppositely-handed threads on the shafts 35 and 36 and the slug 40 engaged therewith. Other arrangements of screw-threaded adjusters between the two shafts could be employed.

There are several well known problems associated with Stirling engines as has been discussed hereinbefore. One of those is leakage of the working fluid past the piston seals and also past the output shaft-to-casing seals. Though this merely leads to a loss of efficiency if that working fluid is air, far better efficiency can be achieved with hydrogen or helium as the working fluid, but it is much more difficult to prevent leakage with gases of such low molecular weight. It is moreover more expensive to replenish lost gas of this kind.

The machine described above addresses this problem by providing sealed casings around the eccentric mechanisms and then seeking to maintain the pressure drop across any one piston to a minimum value. It will be appreciated that as each set of four piston-and-cylinder combinations has the combinations arranged in opposed pairs, the pressure variation in the sealed casing will be minimised: as one piston moves from bottom dead centre to top dead centre, the 180° opposed piston moves from top dead centre to bottom dead centre and thus the total volume within the casing should not change but when operating dynamically, due to the movement of the gas within the casing, there will in fact be pressure changes therein. This effect is minimised by use of the eccentric mechanism as described above, since this allows the contained volume within the casing to be minimised. Moreover, the eccentric mechanism controls the movement of the pistons to be truly sinusoidal, unlike the case with a conventional crank and connecting rod assembly.

Conversely to the pressure within the casing, the pressure of the working fluid on the sides of the pistons remote from the eccentric mechanisms will vary, as the working fluid moves from the hot piston-and-cylinder combinations to the cold piston-and-cylinder combinations, and vice versa. This will lead to some leakage past the pistons but in an attempt to minimise that, in accordance with this invention the pressure in each casing is monitored as well as the pressure in each transfer duct, and then the casing pressure is adjusted as required in an attempt to maintain that pressure difference within a narrow band, to minimise leakage. The regime is that the pressure in the casing should always be slightly less than the pressure in the transfer ducts so that any leakage of working fluid will be from the sides of the piston remote from the eccentric mechanisms, into the casing.

In FIG. 1, there are shown casing pressure tappings 46 and 47, respectively in the set of hot piston-and-cylinder combinations and cold piston-and-cylinder combinations, and transfer duct pressure tappings 48. These tappings are connected to a control unit 49 which compares the determined pressures and then drives more fluid into a casing or the working space, or extracts fluid from the casing or the working space (as appropriate) to maintain the pressure difference within the pre-defined band. The control unit 49 includes a working fluid source and a pump together with appropriate valving arrangements (none of which are shown) whereby the fluid may be driven into or extracted from the required space, with the aim of maintaining the pressure within the casing at slightly less than the minimum pressure occurring within the transfer ducts.

Figure 3:
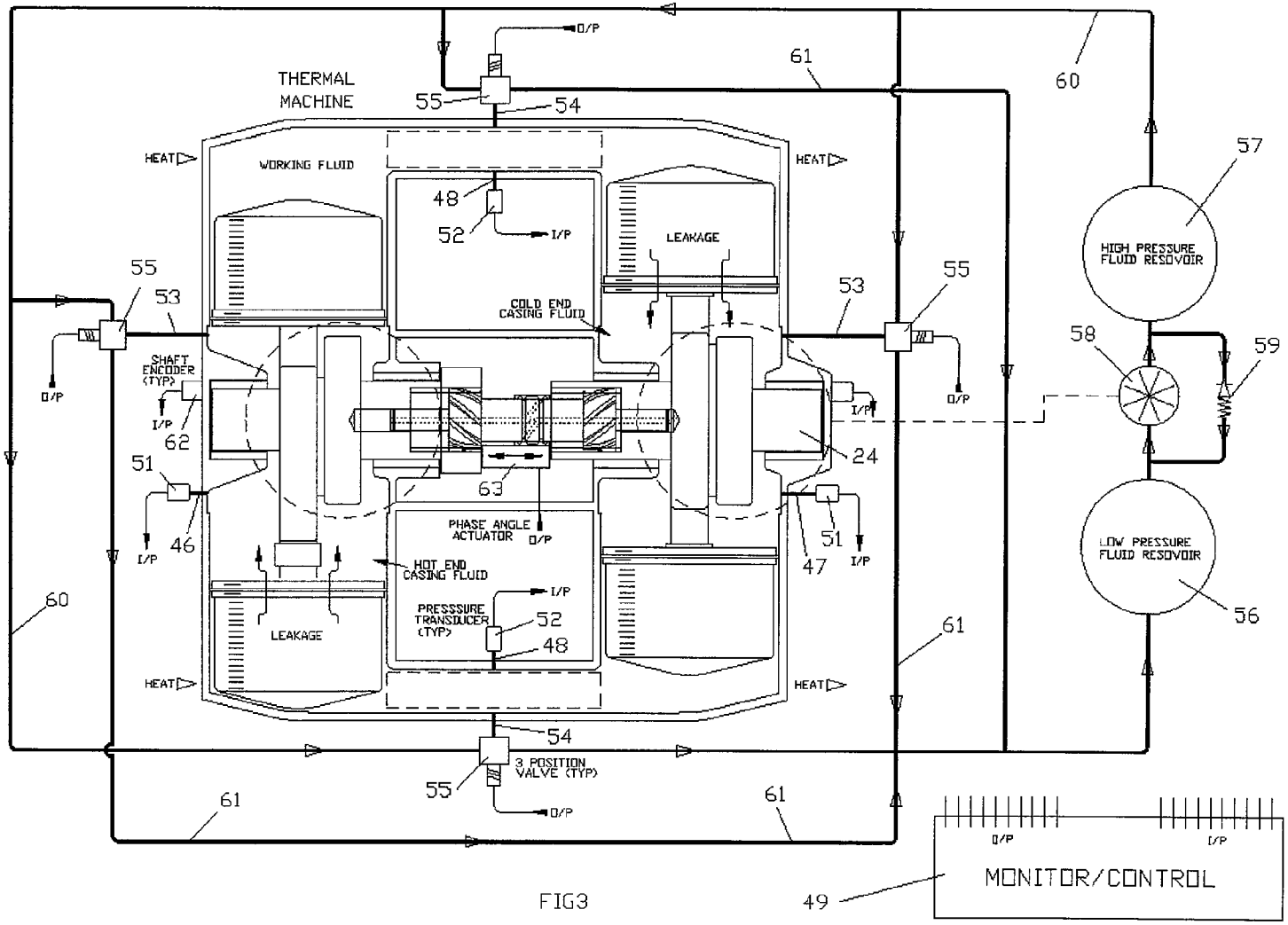

Referring now to FIG. 3, there is shown a machine based on that of FIG. 1 but modified by the phase adjustment mechanism of FIG. 2. FIG. 3 includes details of an electronic pressure control arrangement.

Pressure transducers 51 are connected to the casing pressure tappings 46,47 and provide electrical inputs to the control unit 49, which typically is in the form of a microcomputer or PLC. Similarly, further pressure transducers 52 are connected to the duct pressure tappings 48 and also provide electrical inputs to the control unit 49. There are further pressure tappings 53 and 54 respectively to the casings and ducts, respective three-position valves 55 being provided on each such further pressure tapping.

The system includes a low-pressure fluid reservoir 56 and a high-pressure fluid reservoir 57 with a pump 58 arranged to transfer fluid from the low-pressure reservoir to the high-pressure reservoir, the pump being optionally driven from the output shaft 24 of the machine. A pressure by-pass valve 59 is arranged across the pump to ensure that the fluid pressure difference between the two reservoirs does not exceed a pre-set value.

The high-pressure fluid reservoir is connected through pipes 60 to one side of the three-position valves 55 and the low-pressure fluid reservoir to the other side of those valves through pipes 61, with the control unit 49 providing a control signal to each of those valves as required. That control signal may maintain the associated valve in a closed setting, or may either allow the introduction of fluid from the high-pressure reservoir into the associated space through the pressure tapping or allow fluid to flow from that space to the low-pressure reservoir.

The control unit 49 is programmed to monitor the inputs from the casing and duct transducers and provide outputs to the valves 55 in an attempt to maintain a pressure regime within the working fluid and casings to ensure that there is a minimum leakage of working fluid from the working spaces of the pistons, into the casings. By maintaining the pressure difference at a predetermined minimal value, that leakage can be minimised. As the pressure in the casings rises due to leakage past the pistons and also on account of a temperature rise when in operation, fluid is moved out of those casings. As the pressure in the working fluid drops due to leakage past the pistons, fluid is moved into the working spaces. The use of the eccentric mechanisms allows the volume in the casings to be minimised and moreover the movement of the opposed pairs of pistons is strictly sinusoidal. As such, pressure variations in the casings are minimised and though the pressure in the working fluid will vary with operation of the machine, the casing pressure may easily be maintained below the minimum working pressure of the fluid. The control unit 49 may operate with an appropriate algorithm to achieve this result.

Also shown in FIG. 3 is a shaft position encoder 62 providing an output to the control unit 49, and a phase angle actuator 63 (shown diagrammatically) for controlling the position of the slug 40, driven b the control unit 49. These are provided to assist start-up of the engine, as will be described below.

Figure 4:
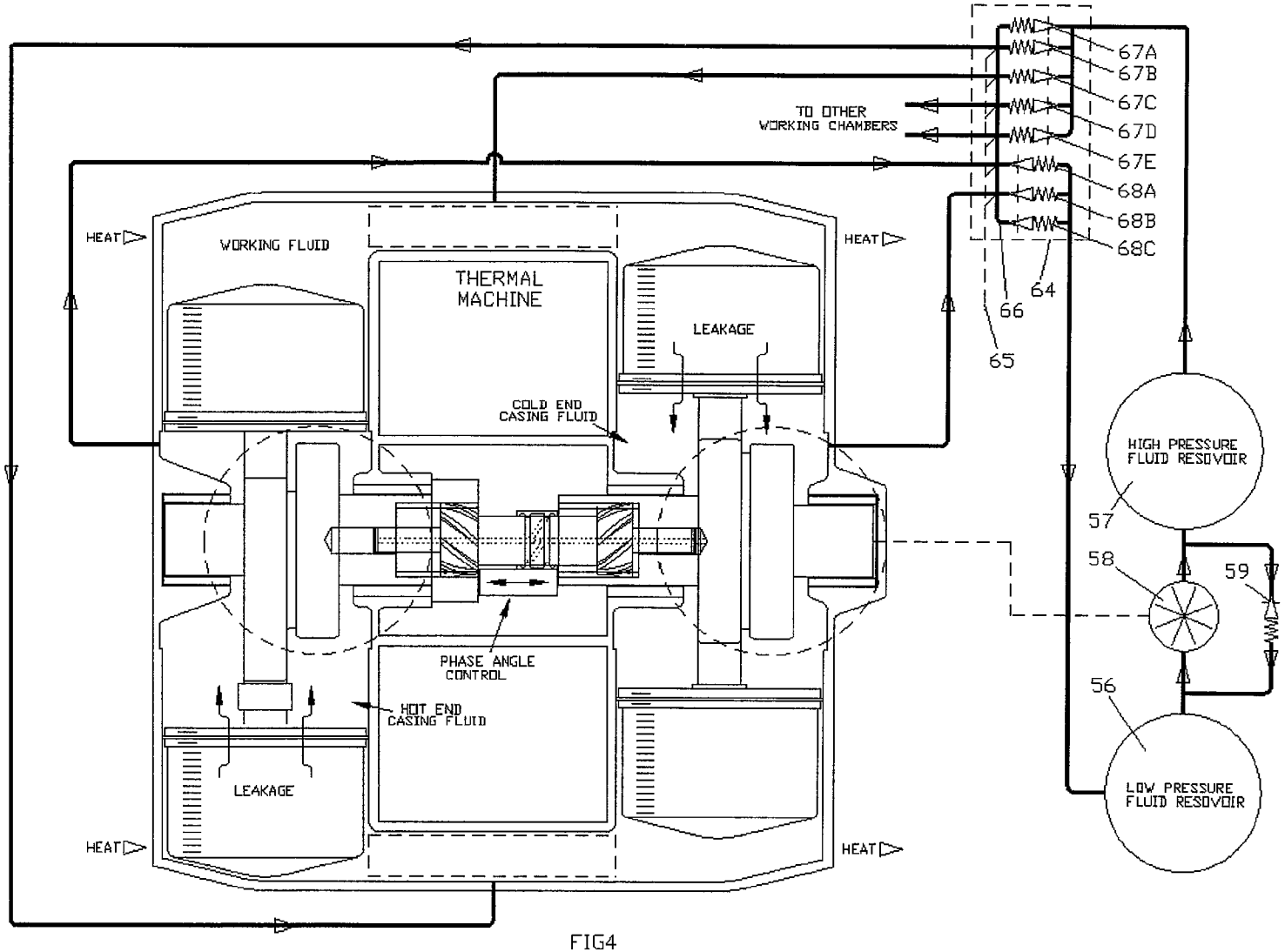

FIG. 4 shows an arrangement where the control unit 49 is replaced by a valve chest 64 which operates solely on the basis of the various pressures prevailing in the machine, without the need to provide a separate electronic control unit. As shown, the valve chest includes eight automatically operating pressure-sensitive valves but only six of those are shown connected to the machine. Each valve is a one-way valve which is normally closed but opens when the pressure difference across the valve exceeds a pre-set value. The arrangement of the low-pressure and high-pressure fluid reservoirs 56 and 57, the pump 58 and pressure by-pass valve 59 are all the same as has been described with reference to FIG. 3. No pressure sensors nor valves are associated with the pressure tappings, as in the FIG. 3 arrangement; rather, those tappings are connected back to the valves in the valve chest 64.

A control 65 is provided for the valve chest, to switch the operation from the normal configuration as shown in FIG. 4, to a start-up configuration where passageway 66 within the valve chest interconnects the output sides of the upper five valves 67A to 67E shown in FIG. 4 in the valve chest and also the input sides of the lower three valves 68A to 68C. When in its normal configuration, the passageway 66 is out of circuit and the respective output sides of the five valves 67A to 67E and the respective input sides of the valves 68A to 68C are not interconnected.

The arrangement of FIG. 4, when used in conjunction with the possibility of adjusting the phase angle between the hot and cold piston-and-cylinder combinations by way of the phase angle actuator 63, allows the problem of initial pressurisation of the machine to be resolved. When the machine is cold and at rest, the phase angle is adjusted to put the hot and cold piston pairs 180° out of phase, thus enclosing a working fluid volume slightly larger than the normal operating maximum working fluid volume. As a result of the eccentric mechanisms giving rise to true sinusoidal motion, the working volumes are identical irrespective of the static phase angle, so that all parts of the machine can be simultaneously charged to a common pressure set at a predetermined percentage of the operating design pressure for the working fluid. The predetermined percentage is based on a function of various engine parameters, ambient temperature, kind of working fluid and so on.

The machine is started by setting the control 65 of the valve chest to the start-up configuration and then heat is applied to the machine so that the temperature and pressure of the working fluid rises. Simultaneously there will be some leakage of that working fluid to the casing, so increasing the pressure in that casing. Then, rotation commences on moving the valve chest control 65 to the normal operating position together with the shifting of the phase angle between the hot piston-and-cylinder combinations and cold piston-and-cylinder combinations from 180° to the working angle, which typically will be at or about 90° or at or about 270°, depending upon the required direction of rotation. Operation of the machine should then commence and will continue with automatic pressure adjustment within a stable loop.

FIG. 5 shows a modification of the mechanism described in WO96/23991 and as in that specification, only one set of four piston-and-cylinder combinations is illustrated. Here, two eccentrics 70 are mounted adjacent each other, on a common axis 71 but at 180° out of phase to each other, there being two externally-toothed gears 72 on the axis 71, one to each side of the pair of eccentrics (FIGS. 5F and 5G). The two output shafts with which the eccentrics co-operate are best seen in FIGS. 5H and 5J; the shaft 73 carries an internally-toothed hub 74 which meshes with one of the gears 72 and there is a second similar output shaft with meshes with the other gear 72. FIGS. 5C to 5E show one of the two linear sliding elements 75 of the mechanism, the element having a circular central opening 76 within which one of the eccentrics 70 is received.

With the mechanism of FIG. 5, it is important that the gear ratio of gear 72 and internally-toothed hub 74 is not 2:1. If it is, there will be no rotary motion imparted to the output shafts 73 but by having some other ratio, there will be rotary motion.

FIG. 6 illustrates yet another modified form of the mechanism of WO96/23991 and broadly corresponds to that described above with reference to FIG. 5, except that the arrangement of FIG. 6 does not include any output shafts and so equally there are no gears associated with the two eccentrics 78. In this embodiment, the eccentrics will rotate within the openings 76 in the sliding elements 75 which correspond precisely to those illustrated in FIGS. 5C to 5E, operating along axes at 90° to each other. This mechanism is not intended to produce a rotary output but could instead form the basis of a pump, with two of the piston-and-cylinder combinations producing power and the other two piston-and-cylinder combinations serving as pump chambers driven by said first two piston-and-cylinder combinations. In the alternative, the mechanism could be arranged as an electrical generator, with all four piston-and-cylinder combinations producing power in the manner described with reference to FIG. 1 and coils 79 being arranged adjacent the sliding elements in a suitable manner to allow the generation of electricity.

FIG. 7 shows yet another mechanism generally similar to that of FIG. 5 but having an output shaft 73 (FIGS. 7E and 7F) provided with external teeth 77 which mesh with the external gears 72 of the eccentrics 70, shown in FIGS. 7C and 7D, and which correspond to the eccentrics of FIGS. 5F and 5G. The sliding element (FIGS. 7G, 7H and 7J) is essentially the same as has been described hereinbefore but is differently proportioned as compared to the embodiment of FIG. 5. In other respects, the mechanism of FIG. 7 generally corresponds to that of the embodiment of FIG. 5 and will not be described in further detail here.

The mechanism of FIG. 8 is again broadly similar to those described above in that the mechanism includes a pair of sliding elements 75 the same as those of FIG. 5 and which therefore will not be described again here, though they are shown in FIGS. 8A and 8B. The central openings of the sliding elements receive the respective eccentrics shown in FIGS. 8C and 8D and these are essentially the same as those of the embodiment of FIG. 5 except that the externally-toothed gears 80 are spaced axially from the adjacent eccentrics 81 by stub shafts 82. In this embodiment, each gear 80 must be separable from its stub shaft 82 to allow assembly but the details of this connection are not central to the invention and will not be described here.

The output shaft for this mechanism is shown in FIGS. 8E and 8F. The shaft 83 is journalled in a casing 84 (FIGS. 8G and 8H) which defines a counterbore internally of the mechanism, that counterbore being provided with internal teeth. Stub shaft 82 is carried in a bore 85 formed in a counterweight 86, being a part of the output shaft. The gear 80 is received in a recess 87 in the output shaft, within a boss 88 interconnecting the main part 83 of the output shaft with the counterweight 86. Thus, the common axis of the external gears 80 is eccentric with respect to the axis of the two output shafts.

The assembly of one side of this mechanism is shown in FIGS. 8G and 8H. As can be seen, externally-toothed gear 80 meshes with the internal gear in the counterbore of the casing 84, with that gear received in the recess 87 of the output shaft. The gear ratio of gear 80 with the internal teeth must be 2:1 for the mechanism to operate, such that as the eccentrics 81 are driven by the sliding elements 75, the gears 80 run around the internal teeth of the casing, so rotating the output shaft. The counterweight 86 is intended to compensate for the mass of the eccentrics and the sliding elements, as the output shaft is rotated by the eccentrics 81.

Figure 9F:
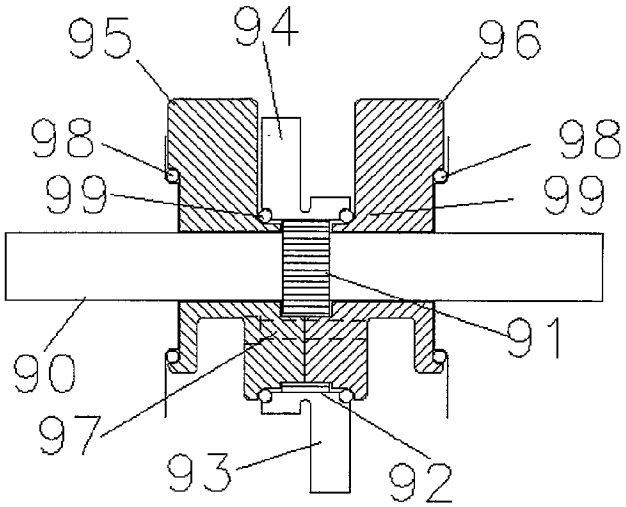
Figure 9D:
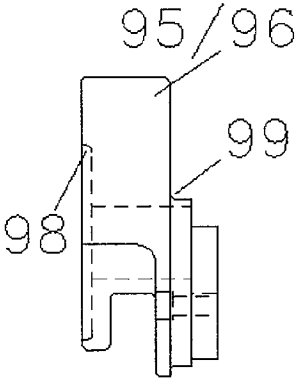
Figure 9E:
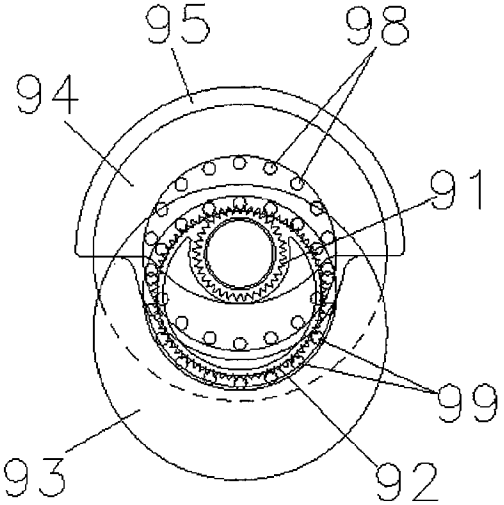
Figure 9C:
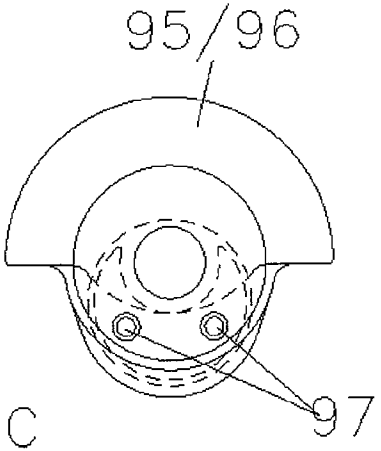
Figure 10B:
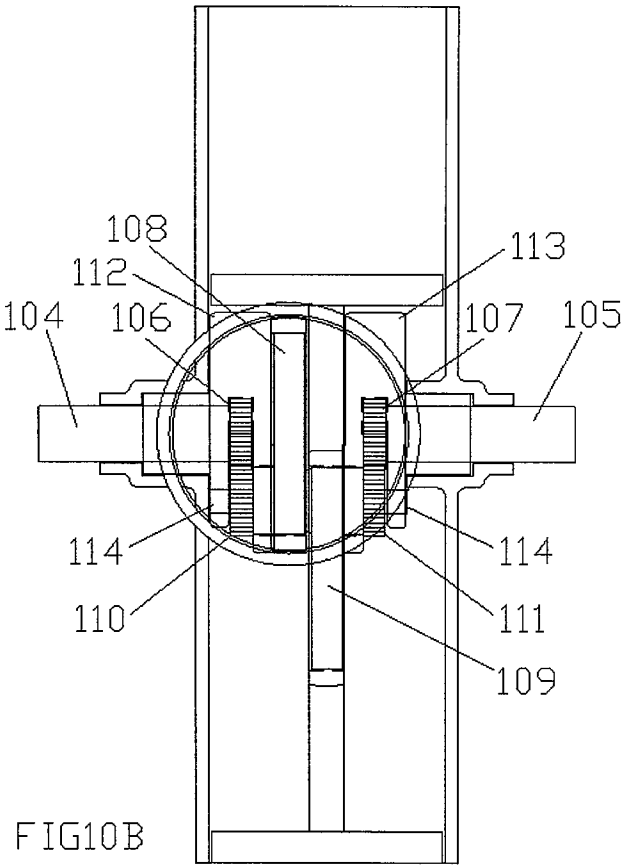
Figure 10A:
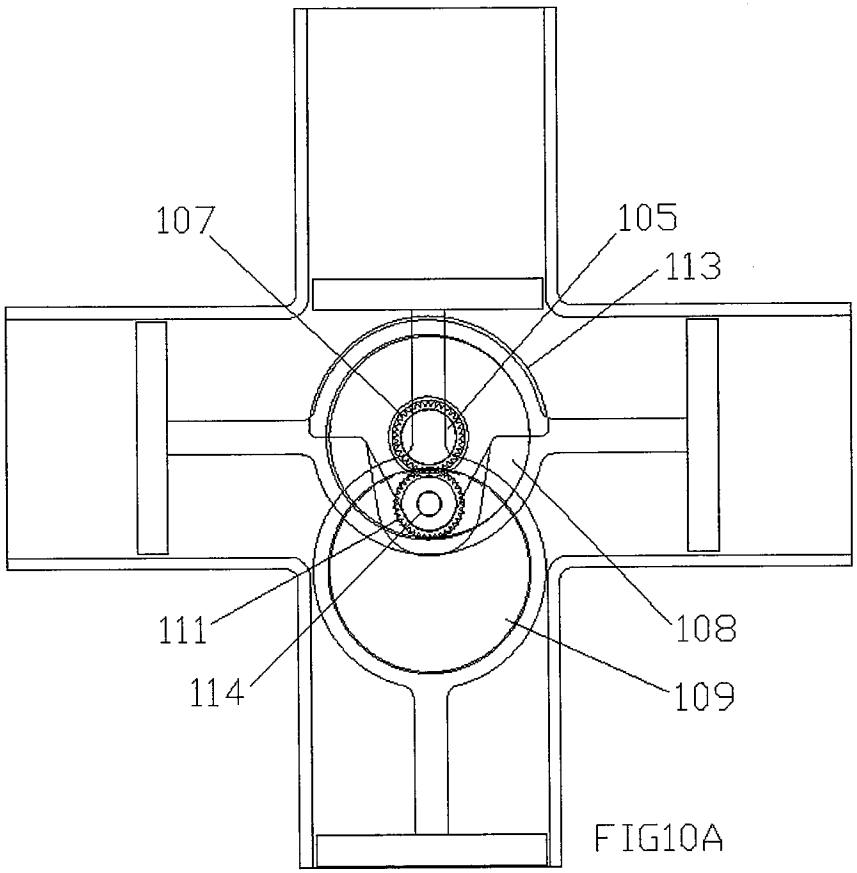
Figure 10E:
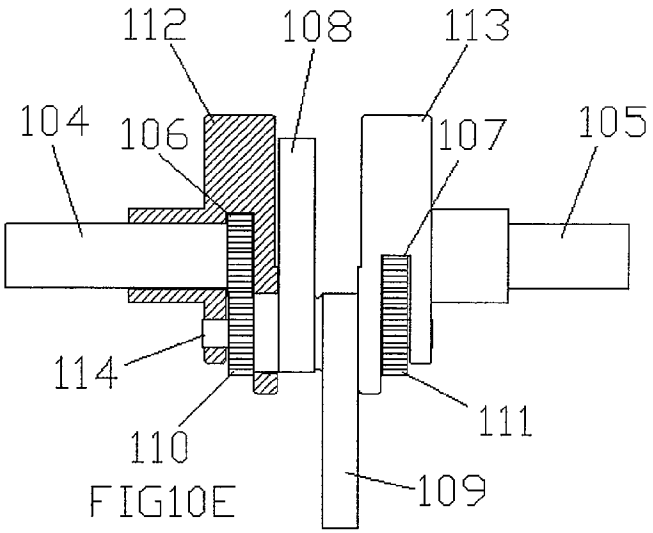
Figure 10D:
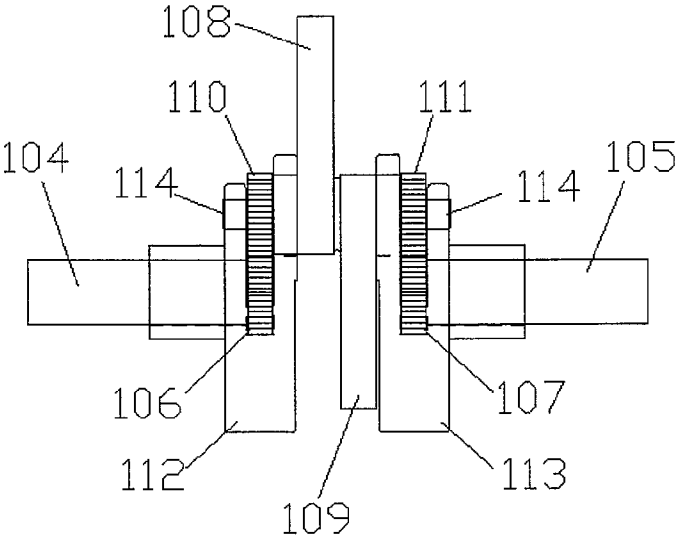
Figure 10C:
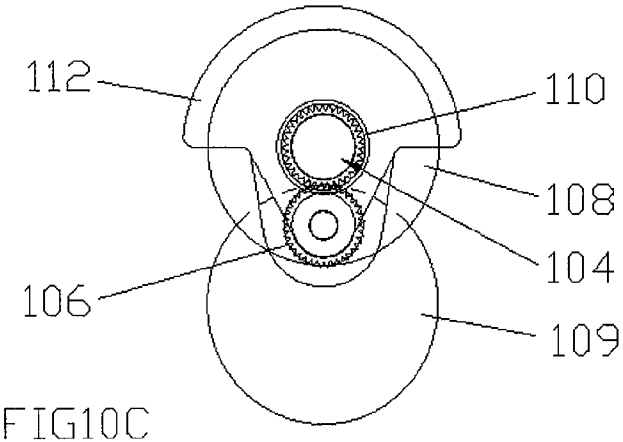

FIGS. 9A to 9F show a mechanism similar to that described in WO96/23991 and as with that mechanism there is a single output shaft 90 provided with an externally-toothed central gear 91 meshing with the teeth of an internal gear 92 formed within the adjacent out-of-phase eccentrics 93,94. A pair of counterweights 95,96 (FIGS. 9C and 9D) are journalled on the output shaft 90, one to each side of the central gear 91 thereof and as best seen in FIGS. 9E and 9F are profiled to accommodate the geared connection between the output shaft and the eccentrics. The counterweights are connected together by pins 97 for rotation in unison around the output shaft 90 and ball races 98 are provided between each counterweight and the adjacent crankcase.

The eccentrics 93,94 are carried on ball races 99 arranged between those eccentrics and the counterweights, with one ball race to each side of the central gear 91. Each counterweight has an off-centre balance weight which will rotate around the axis of the output shaft in synchronism with the rotation of the eccentrics 93,94 and thus serve to balance the reciprocating mass of the sliding elements and the eccentrics, with the counterweights linking together the eccentrics and the output shafts.

The arrangement of FIGS. 10A to 10E is somewhat similar in concept to that of the FIG. 9 embodiment, but here there are two output shafts 104,105 each carrying an external gear 106,107 disposed one to each side respectively of the eccentrics 108,109. Those gears 106,107 mesh with externally-toothed gears 110,111 respectively, associated with the eccentrics. Each output shaft carries a respective counterweight 112,113 having a radial slot within which are received the meshed external gears respectively of the output shaft and the associated eccentric, the gear of the eccentric having a stub shaft 114 journalled in the counterweight.

In operation, the eccentrics are driven by the reciprocating movement of the sliding elements, so that the eccentrics rotate around the axis of the output shafts. This rotates the associated eccentric gears 110,111 to drive the output shaft gears 106,107, so effecting rotation of the output shafts. Moreover, the movement of the eccentrics around the output shafts also causes the counterweights to rotate in synchronism with the rotation of the eccentrics, thus balancing the reciprocating masses, with the counterweights linking together the eccentrics and the output shafts.

FIGS. 11A and 11B show a mechanism different from the double eccentric mechanisms described above, for interconnecting the pairs of displacers and output shaft. The mechanism of FIGS. 11A and 11B is based on a Scotch linkage and produces true sinusoidal motion of the displacers on rotation of the shaft.

In FIGS. 11A and 11B, the pairs of displacers 120 are carried on mounts 121 just as with the above described embodiments, each pair of displacers running in respective aligned bores 122 with the axes of the bores mutually at right angles. Centrally of each mount there is provided a frame 123 which defines a slot extending at 90° to the length of the mount, the two slots of the two mounts therefore extending at 90° to each other. An output shaft 124 is journalled in the mechanism casing 125 and carries a crank pin 126 on a counterweight web 127 secured to the shaft 124. Axial movement of the displacers in their respective bores produces rotation of the shaft 124 but the movement of the displacers is controlled to be truly sinusoidal motion by virtue of the Scotch linkage. As a consequence, the volume within the casing containing the linkage does not vary notwithstanding the reciprocating movement of the displacers. In turn, this allows the mean pressure within the casing to remain constant such that the pressure may be controlled to be just less than the minimum working fluid pressure on the other sides of the displacers.

The invention claimed is:

1. A heat machine operating with an external heat source and an external heat sink and having:

a first pair of displacers provided on a common first mount and working in opposed first bores formed in first cylinders;

a first casing enclosing a volume between the first pair of displacers;

a second pair of displacers provided on a common second mount and working in opposed second bores formed in second cylinders;

a second casing enclosing a volume between the second pair of displacers;

a mechanism interconnecting the first and second mounts and arranged to maintain a phase angle between the first and second pair of displacers; and working fluid chambers defined by spaces in the cylinders on the sides of the displacers remote from the mounts, wherein there are pressure monitoring means including pressure tappings and pressure transducers for monitoring the pressures in said casings and for monitoring the pressures in said chambers, comparison means for comparing the monitored pressures, and pressure adjusting means for adjusting the fluid pressure in one or both of the casing and working fluid chambers dependent upon the result of the comparison of the monitored pressures as required for the pressure in the casings to be maintained at a value below the pressure in the working fluid chambers.

2. A machine as claimed in claim 1, wherein the pressure adjusting means is arranged to drive fluid into the casing or to withdraw fluid from the casing as required to have the pressure in the casing maintained below the pressure in the working fluid chambers.

3. A machine as claimed in claim 1, wherein said pressure adjusting means maintains the pressures in the first and second casings to be substantially the same.

4. A machine as claimed in claim 3, wherein the first and second casings are integrated into a single casing.

5. A machine as claimed in claim 1, and further comprising:

a third pair of displacers provided on a common third mount and working in opposed third bores formed in third cylinders;

a third casing enclosing a volume between the third pair of displacers;

a fourth pair of displacers provided on a common fourth mount and working in opposed fourth bores formed in fourth cylinders;

a fourth casing enclosing a volume between the fourth displacers;

a mechanism interconnecting the third and fourth mounts and arranged to maintain a phase angle between the third and fourth pairs of displacers;

said mechanism interconnecting the third and fourth mounts being arranged to maintain a phase angle with respect to the first and second mounts; and third and fourth working fluid chambers defined by the spaces in the cylinders on the sides of the third and fourth displacers remote from the mounts, wherein there are pressure monitoring means for monitoring the pressures in said third and fourth casings and in the corresponding working spaces, wherein said pressure monitoring means includes pressure tappings and pressure transducers, comparison means for comparing the pressures in said third and fourth casings and in said third and fourth working fluid chambers, and pressure adjusting means for adjusting the fluid pressure in one or both of the third and fourth casings and the third and fourth working fluid chambers dependent upon the result of the comparison of the monitored pressures as required for the pressure in the third and fourth casings to be maintained at a value below the pressure in the working fluid chambers.

6. A machine as claimed in claim 5, wherein the mechanism associated with each of the pairs of displacers includes a rotary output shaft.

7. A machine as claimed in claim 5, wherein the first and third casings are integrated into a common casing and the second and fourth casings are integrated into a further common casing.

8. A machine as claimed in claim 7, wherein there are further pressure adjusting means for maintaining the pressures in the common first and third casings and in the second and fourth casings to be substantially the same.

9. A machine as claimed in claim 8, wherein the common first and third casings and the common second and fourth casings are integrated into a single casing.

10. A machine as claimed in claim 9, wherein a first mechanism is associated with the first and third pairs of displacers, and a second mechanism is associated with the second and fourth pairs of displacers, the mechanisms being coupled together for synchronous operation.

11. A machine as claimed in claim 10, wherein there are means for adjusting the phase angle between the first and third pairs of displacers and the second and fourth pairs of displacers by adjustment of the relative phase of the first and second mechanisms.

12. A machine as claimed in claim 1, wherein the mechanism associated with each of the pairs of displacers includes a rotary output shaft.

13. A machine as claimed in claim 6, wherein there are means for adjusting the phase of the first and second pairs of displacers with respect to the third and fourth pairs of displacers.

14. A machine as claimed in claim 13, wherein the output shafts are substantially co-axial and have confronting end portions, and the means to adjust the relative phase of the output shafts comprises respective output gears on the confronting end portions of the shafts and a further gear meshed with the output gears and having an axis substantially in a radial plane with respect to the output shafts, whereby adjustment of the further gear in said radial plane effects adjustment of the relative angle between the output shafts.

15. A machine as claimed in claim 13, wherein the output shafts have confronting end portions, and wherein the confronting end portions are threaded with threads of opposite hands and an adjusting component is engaged with said threads and is arranged for axial movement relative to the output shafts thereby to effect adjustment of the relative angle therebetween.

16. A machine as claimed in claim 1, wherein each displacer is in the form of a piston arranged for reciprocating movement within a respective cylinder bore with a seal formed between the piston and the bore.

17. A machine as claimed in claim 1, wherein the first pair of displacers is associated with a heat source and the second pair of displacers is associated with a heat sink.

18. A machine as claimed in claim 1, wherein the mechanism is arranged to control the movement of the displacers to be essentially sinusoidal.

19. A machine as claimed in claim 18, wherein the mechanism comprises an eccentric drive arrangement including an output shaft, whereby the associated mount for the displacers is controlled to perform reciprocating movement corresponding to rotation of the output shaft.

20. A machine as claimed in claim 19, wherein the eccentric drive arrangement comprises an eccentric member having an external surface coupled to a displacer mount, a gear arranged eccentrically to the external surface of the eccentric member, and an output shaft having a gear meshed with the gear of the eccentric member.

21. A machine as claimed in claim 20, wherein the eccentric member has a bore with internal teeth and the gear of the output shaft has external teeth meshed therewith.

22. A machine as claimed in claim 20, wherein the gear of the eccentric member is in the form of a projecting boss provided with external teeth and the gear of the output shaft has either external teeth or internal teeth meshed with the teeth of the boss.

23. A machine as claimed in claim 20, wherein the eccentric member carries an externally-toothed gear meshed with an externally-toothed gear provided on the output shaft and around which the eccentric member toothed gear runs.

24. A machine as claimed in claim 20, wherein the eccentric member carries an externally-toothed gear meshed with an internally-toothed ring provided on the output shaft and within which the eccentric member toothed gear runs.

25. A machine as claimed in claim 20, wherein the eccentric member carries an externally-toothed gear meshed with an internally-toothed ring provided on the crankcase, the eccentric member toothed gear running around that toothed ring and driving the output shaft.

26. A machine as claimed in claim 5, in which each mechanism comprises an eccentric drive arrangement including an output shaft, whereby the associated mount for the displacers is controlled to perform reciprocating movement corresponding to rotation of the output shaft and wherein the first and third pairs of displacers are disposed substantially at 90° to each other and the second and fourth pairs of displacers are disposed substantially at 90° to each other, and for the first and third pairs of displacers and for the second and fourth pairs of displacers each eccentric drive mechanism comprises two connected eccentric members at 180° to each other, one eccentric member having an external surface coupled to the mount of one pair of displacers and the other eccentric member having an external surface coupled to the mount of the other pair of displacers.

27. A machine as claimed in claim 1 and arranged as an electrical generator, said machine having electrical coils disposed adjacent the mounts of the displacers whereby the coils generate an EMF upon operation of the machine.

28. A machine as claimed in claim 1 and configured as an external combustion engine.

29. A machine as claimed in claim 28 and configured as an engine to operate substantially on the Stirling cycle.

30. A machine as claimed in claim 5 and wherein the machine is configured as a Stirling engine having hot and cold pairs of displacers, wherein there are:

mechanisms controlling movement of the displacers which mechanisms produce essentially sinusoidal motion of the displacers thereby to maintain constant the volume within the casings for the mechanisms; and adjustment means for adjusting the relative phase of the hot and cold pairs of displacers, by adjusting the phase of the two mechanisms respectively for the hot pairs of displacers and the cold pairs of displacers.

31. A method of operating a heat machine with an external heat source and an external heat sink, the machine having:

a first pair of displacers provided on a common first mount and working in opposed first bores formed in first cylinders;

a first casing enclosing a volume between the first pair of displacers;

a second pair of displacers provided on a common second mount and working in opposed second bores formed in second cylinders;

a second casing enclosing a volume between the second pair of displacers;

a mechanism interconnecting the first and second mounts and arranged to maintain a phase angle between the first and second pair of displacers; and working fluid chambers defined by spaces in the cylinders on the sides of the displacers remote from the mounts;

in which method heat from the external heat source is supplied to the working fluid in the working fluid chambers adjacent the first pair of displacers, heat from the working fluid in the working fluid chambers adjacent the second pair of displacers is dumped to the external heat sink, the pressures in said casings and in said working fluid chambers are monitored by pressure monitoring means including pressure tappings and pressure transducers and compared by a comparison means, and the pressure of fluid in one or both of the casings and chambers is adjusted dependent upon the result of the comparison so that the pressure in the casings is maintained below the pressure in the working fluid chambers.

32. A method as claimed in claim 31 and wherein the machine includes a transfer duct interconnecting the working fluid chambers respectively adjacent the first and second pair of displacers, the pressure in the chambers being assessed by monitoring the pressure in the transfer duct.

33. A method as claimed in claim 31, in which the pressure in the casings is maintained to be less than the minimum monitored pressure in the working fluid chambers.

* * * * *